US009631864B2

(12) United States Patent
Chen et al.

(10) Patent No.: US 9,631,864 B2
(45) Date of Patent: Apr. 25, 2017

(54) HEAVY HYDROCARBON REMOVAL FROM A NATURAL GAS STREAM

(75) Inventors: Fei Chen, Whitehouse Station, NJ (US); Xukun Luo, Allentown, PA (US); Christopher Michael Ott, Laurys Station, PA (US); Mark Julian Roberts, Kempton, PA (US); Gowri Krishnamurthy, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 89 days.

(21) Appl. No.: 13/611,169

(22) Filed: Sep. 12, 2012

(65) Prior Publication Data

US 2014/0033763 A1 Feb. 6, 2014

Related U.S. Application Data

(63) Continuation-in-part of application No. 13/565,881, filed on Aug. 3, 2012, now abandoned.

(51) Int. Cl.
*F25J 1/00* (2006.01)
*C10L 3/10* (2006.01)
(Continued)

(52) U.S. Cl.
CPC ..... *F25J 1/0022* (2013.01); *C10L 3/10* (2013.01); *C10L 3/101* (2013.01); *F25J 1/0231* (2013.01);
(Continued)

(58) Field of Classification Search
CPC ..... F25J 1/0022; F25J 1/0237; F25J 1/0238; F25J 3/061; F25J 3/0209; F25J 1/065;
(Continued)

(56) References Cited

U.S. PATENT DOCUMENTS 3,792,590 A 2/1974 Lofredo et al.
3,841,058 A 10/1974 Templeman
(Continued)

FOREIGN PATENT DOCUMENTS

EA 200970972 A1 4/2010
JP 4621204 A 6/1971
(Continued)

OTHER PUBLICATIONS

Kumar, R., A Versatile Process Simulator for Adsorptive Separations, Chemical Engineering Science, vol. 49, No. 18, pp. 3115-3125, 1994.
(Continued)

*Primary Examiner* — Frantz Jules
*Assistant Examiner* — Brian King
(74) *Attorney, Agent, or Firm* — Eric J. Schaal

(57) ABSTRACT

A method and apparatus of removing heavy hydrocarbons from a natural gas feed stream, the method comprising using first and second hydrocarbon removal systems in series such that the first system processes the natural gas feed stream to produce a heavy hydrocarbon depleted natural gas stream and the second system processes at least a portion of the heavy hydrocarbon depleted natural gas stream from the first system to produce a natural gas stream lean in heavy hydrocarbons, wherein one of said systems is a adsorption system that comprises one or more beds of adsorbent for adsorbing and thereby removing heavy hydrocarbons from a heavy hydrocarbon containing natural gas, and the other of said systems is a gas-liquid separation system for separating a heavy hydrocarbon containing natural gas into a heavy hydrocarbon depleted natural gas vapor and a heavy hydrocarbon enriched liquid.

10 Claims, 9 Drawing Sheets

(51) Int. Cl.
*F25J 3/02* (2006.01)
*F25J 3/06* (2006.01)
*F25J 1/02* (2006.01)

(52) U.S. Cl.
CPC ..... *F25J 1/0237* (2013.01); *F25J 1/0238* (2013.01); *F25J 3/0209* (2013.01); *F25J 3/0233* (2013.01); *F25J 3/0247* (2013.01); *F25J 3/061* (2013.01); *F25J 3/065* (2013.01); *F25J 3/0635* (2013.01); *C10L 2290/06* (2013.01); *C10L 2290/10* (2013.01); *C10L 2290/12* (2013.01); *C10L 2290/48* (2013.01); *C10L 2290/542* (2013.01); *C10L 2290/545* (2013.01); *F25J 2200/40* (2013.01); *F25J 2205/40* (2013.01); *F25J 2205/60* (2013.01); *F25J 2205/66* (2013.01); *F25J 2210/06* (2013.01); *F25J 2210/62* (2013.01); *F25J 2220/60* (2013.01); *F25J 2220/64* (2013.01); *F25J 2230/30* (2013.01); *F25J 2245/02* (2013.01); *F25J 2245/90* (2013.01)

(58) Field of Classification Search
CPC ..... F25J 1/0635; F25J 1/0277; F25J 2200/60; F25J 2245/02; F25J 2245/90; F25J 2205/40; F25J 2205/60; F25J 2205/66; F25J 2230/30; B01D 53/02; C10L 3/10
USPC ..... 62/618; 61/618
See application file for complete search history.

(56) References Cited

U.S. PATENT DOCUMENTS 4,352,685 A * 10/1982 Swallow ..... C07C 7/04 62/630
4,441,900 A * 4/1984 Swallow ..... C07C 7/09 62/622
4,533,372 A * 8/1985 Valencia ..... F25J 3/0209 62/629
4,761,167 A * 8/1988 Nicholas et al. ..... 62/626
5,062,270 A * 11/1991 Haut ..... F25J 3/0209 62/629
5,120,338 A * 6/1992 Potts, Jr. ..... F25J 3/0209 62/629
5,325,673 A 7/1994 Durr et al.
5,451,249 A 9/1995 Spiegel et al.
5,486,227 A 1/1996 Kumar et al.
6,568,206 B2 * 5/2003 Scharpf ..... 62/624
7,600,395 B2 10/2009 Eaton et al.
2004/0261453 A1 * 12/2004 Guillard et al. ..... 62/643
2005/0072186 A1 4/2005 Amin et al.
2005/0284176 A1 12/2005 Eaton et al.
2007/0006732 A1 * 1/2007 Mitariten ..... B01D 53/0462 95/237
2007/0062216 A1 * 3/2007 Mak et al. ..... 62/620
2007/0267328 A1 * 11/2007 Neumann ..... C10G 5/02 208/303
2008/0282884 A1 11/2008 Kelley et al.
2011/0048067 A1 * 3/2011 Fischer et al. ..... 62/620
2011/0185896 A1 * 8/2011 Sethna ..... B01D 53/002 95/45

FOREIGN PATENT DOCUMENTS

JP 4729712 A 8/1972
JP 5123470 A 7/1976
WO 9518345 A1 7/1995
WO 2005042671 A1 5/2005
WO 2006/042312 A2 4/2006
WO 2006/061400 A1 6/2006
WO 2007/018677 A1 2/2007
WO 2009/074737 A2 6/2009
WO 2011014345 A 2/2011
WO 2011097162 A1 8/2011

OTHER PUBLICATIONS

International Search Report dated Apr. 30, 2014.

* cited by examiner

HEAVY HYDROCARBON REMOVAL FROM A NATURAL GAS STREAM

CROSS-REFERENCE TO RELATED APPLICATIONS

This application is a continuation-in-part application of U.S. application Ser. No. 13/565,881, filed on Aug. 3, 2012, entitled "Heavy Hydrocarbon Removal from a Natural Gas Stream," which is incorporated herein by reference in its entirety.

BACKGROUND

The present invention relates to a method and apparatus for removing heavy hydrocarbons (i.e. aliphatic hydrocarbons having six or more carbon atoms in total and aromatic hydrocarbons—also referred to herein as C6+ hydrocarbons and aromatics, respectively) from a natural gas stream. In certain preferred embodiments, it concerns a method and apparatus for removing heavy hydrocarbons from and liquefying a natural gas stream. The natural gas stream may be a stream that is already lean in aliphatic hydrocarbons having from 3 to 5 carbon atoms in total (also referred to herein as C3-C5 hydrocarbons) and/or a stream that is already lean in aliphatic hydrocarbons having from 2 to 5 carbon atoms in total (also referred to herein as C2-C5 hydrocarbons).

It is important to remove heavy hydrocarbons from a natural gas stream prior to liquefying the natural gas stream, as otherwise the heavy hydrocarbons may freeze in the liquefied natural gas (LNG) stream. It is also known that the heavy hydrocarbon components contained in natural gas feed streams can be removed using temperature swing adsorption (TSA) or by using a scrub column.

As is well known in the art, a scrub column is a type of separation device for removing less volatile components from a feed stream to produce a gas stream depleted in said less volatile components. The feed stream is introduced (as a gaseous stream or as two-phase, gas-liquid stream) into the scrub column, where it is brought into contact with a liquid reflux stream. The reflux stream is introduced into the column at a location that is above the location at which the feed stream is introduced, so that the falling stream of liquid comes into countercurrent contact with the rising stream of vapor originating from the feed stream, thereby "scrubbing" said vapor stream (i.e. removing at least some of the less volatile components from the vapor stream). Typically, the scrub column contains one or more separation stages, positioned below the location at which the reflux stream is introduced and above the location at which the feed stream is introduced, and composed of trays, packing, or some other form of insert that acts to increase the amount and/or duration of contact between the rising vapor and falling reflux streams, thereby increasing mass transfer between the streams.

In the case of treatment of a natural gas stream, a scrub column can be effective in removing all the heavy hydrocarbon components from the stream, but it must be operated at pressures lower than the mixture's critical pressure in order to achieve gas-liquid phase separation. The operating pressure of the column is lower than the optimum natural gas liquefaction pressure, which leads to lower liquefaction process energy efficiency. Also, stable scrub column operation requires sufficient liquid (i.e. reflux) to vapor flow ratio in order to avoid column dryout. The reflux for the column is typically provided by condensing a portion of the gas stream from the top of the column, and if the natural gas feed is in particular too lean in C3-C5 hydrocarbons and/or C2-C5 hydrocarbons (i.e. the concentration of these components is too low) it becomes very energy inefficient to maintain the required liquid to vapor flow ratio inside the column. Therefore, if the natural gas feed is lean in C3-C5 hydrocarbons and/or C2-C5 hydrocarbons and contains relatively high concentrations of heavy hydrocarbons the conventional scrub column technology is energy inefficient.

As is well known in the art, TSA involves at least two steps. During a first step (typically referred to as the "adsorption step") a gaseous feed stream is passed through one or more beds of adsorbent at a first temperature and for a first period of time, during which the adsorbent selectively adsorbs one or more components of the feed, thereby providing a gaseous steam depleted in the adsorbed components. At the end of said adsorption step (which will typically be when the adsorbent is approaching saturation) introduction of the feed stream into the beds in question is stopped. Then, in a subsequent step (typically referred to as a "desorption step" or "regeneration step") the beds are regenerated by desorbing the adsorbed components from the bed(s) at a second, higher temperature, and for a second period of time, sufficient to desorb enough of the adsorbed components to allow the bed or beds in question to be used for another adsorption step. Typically, during the regeneration step another gas stream (referred to as a "regeneration gas") is passed through the bed to aid desorption and the removal of the desorbed components. In some TSA processes (often referred to as temperature pressure swing adsorption, or TPSA, processes), the regeneration step is also carried out at a lower pressure than the pressure during the adsorption step. In most TSA processes it is also the case that two or more beds of adsorbent are used in parallel, with the timings of the adsorption steps being staggered between the beds so that at any point there is always at least one bed undergoing an adsorption step, thereby allowing continuous processing of a feed stream. Each adsorbent bed may contain a single type of adsorbent material, or may contain more than one type of adsorbent material, and where there is more than one bed different beds may contain different materials (in particular where there are two or more beds arranged in series). Suitable types of adsorbent material for selectively adsorbing heavy hydrocarbons are well known.

TSA can be used to effectively remove heavy hydrocarbons from a natural gas stream at the optimum pressure for subsequent liquefaction of the stream, allowing for high liquefaction process energy efficiency. However, if the concentrations of heavy hydrocarbons are too high then the TSA vessel size and the regeneration gas requirements become economically infeasible. Therefore, TSA is effective in removing heavy hydrocarbons in natural gas liquefaction processes only when the concentrations of the heavy hydrocarbons are relatively low. In addition, a further complication is that the TSA adsorbent beds used for hydrocarbon removal need to be regenerated at high temperatures (i.e. 450-600° F., 232-315° C.). At these high temperatures there is a risk of the adsorbed heavy hydrocarbons cracking and producing coke, which will deactivate the adsorbent and be detrimental to productivity.

Prior art in this field includes documents WO 2009/074737, WO 2007/018677, U.S. Pat. No. 3,841,058, and U.S. Pat. No. 5,486,227 (which describe processes in which adsorption systems are used); and U.S. Pat. No. 7,600,395, U.S. Pat. No. 5,325,673, WO 2006/061400, US 2006/0042312, and US 2005/0072186 (which describe processes in which scrub columns are employed).

Accordingly, there is a need in the art for improved methods and apparatus for removing heavy hydrocarbons from natural gas streams, in particular where the natural gas stream has a relatively high concentration of heavy hydrocarbons or where the exact composition of the natural gas stream is liable to vary and/or may otherwise be unknown such that there is a risk of said stream having (at least at times) a relatively high concentration of heavy hydrocarbons.

BRIEF SUMMARY

According to a first aspect of the present invention, there is provided a method of removing heavy hydrocarbons from a natural gas feed stream, the method comprising the steps of using a first heavy hydrocarbon removal system and a second heavy hydrocarbon removal system to process the natural gas feed stream to produce a natural gas stream lean in heavy hydrocarbons, wherein said first and second systems are used in series such that the first system processes the natural gas feed stream to produce a heavy hydrocarbon depleted natural gas stream and the second system processes at least a portion of the heavy hydrocarbon depleted natural gas stream from the first system to produce the natural gas stream lean in heavy hydrocarbons, and wherein one of said systems is an adsorption system that comprises one or more beds of adsorbent for adsorbing and thereby removing heavy hydrocarbons from a heavy hydrocarbon containing natural gas, and the other of said systems is a gas-liquid separation system for separating a heavy hydrocarbon containing natural gas into a heavy hydrocarbon depleted natural gas vapor and a heavy hydrocarbon enriched liquid.

The gas-liquid separation system may be any type of system that is suitable for separating a heavy hydrocarbon containing natural gas (typically a partially condensed heavy hydrocarbon containing natural gas) into a heavy hydrocarbon depleted natural gas vapor and a heavy hydrocarbon enriched liquid. For example, the gas-liquid separation system may comprise a stripping column, a scrubbing column, or a phase separator. Preferably, however, the gas-liquid separation system comprises a stripping column or a phase separator.

The adsorption system may be any type of system that comprises one or more beds of adsorbent suitable for adsorbing and thereby removing heavy hydrocarbons from a heavy hydrocarbon containing natural gas. Preferably, however, the adsorption system comprises a temperature swing adsorption (TSA) system.

The term "portion", as used herein in reference to a stream, and unless otherwise indicated, refers to a portion of a stream that preferably is a divided portion. A divided portion of a stream is a portion of a stream obtained by dividing said stream into two or more portions that retain the same molecular composition (i.e. that have the same components, in the same mole fractions) as said stream from which they have been divided. Thus, for example, in the first aspect of the invention it is preferably the case that the second heavy hydrocarbon removal system either processes the whole of the heavy hydrocarbon depleted natural gas stream from the first heavy hydrocarbon removal system, or processes a divided portion of the heavy hydrocarbon depleted natural gas stream from the first heavy hydrocarbon removal system.

The heavy hydrocarbon components present in the natural gas feed stream that are to be removed comprise one or more hydrocarbons selected from the group consisting of: aliphatic hydrocarbons having six or more carbon atoms in total; and aromatic hydrocarbons. The natural gas stream lean in heavy hydrocarbons, obtained from the second heavy hydrocarbon removal system, is depleted in each of these heavy hydrocarbon components relative to the natural gas feed stream, such that the mole fraction of each of these components in the natural gas stream lean in heavy hydrocarbons is less than that in the natural gas feed stream. The heavy hydrocarbon depleted natural gas stream, obtained from the first heavy hydrocarbon removal system, is depleted in at least some of these heavy hydrocarbon components relative to the natural gas feed stream, such that the total concentration of these components (i.e. the combined mole fraction of these components) in the heavy hydrocarbon depleted natural gas stream is less than that in the natural gas feed stream, although of course not let as low as that in the natural gas stream lean in heavy hydrocarbons obtained from the second heavy hydrocarbon removal system (via removal of heavy hydrocarbons from the heavy hydrocarbon depleted natural gas stream). Preferably, the heavy hydrocarbon depleted natural gas stream, obtained from the first heavy hydrocarbon removal system, is depleted in each of these heavy hydrocarbon components relative to the natural gas feed stream.

In certain embodiments the method may be used to remove heavy hydrocarbons from a natural gas feed stream that has a composition that would render it problematic to treat using a TSA system on its own or scrubbing column on its own. For example: the natural gas feed stream may be lean in aliphatic hydrocarbons having from 3 to 5 carbon atoms in total, such as for example where the total concentration of any and all C3-C5 hydrocarbons in the feed stream (i.e. the concentration of any and all C3-C5 hydrocarbons in the feed stream when taken together) is 5 mol % or less, or 3 mol % or less, or 2 mol % or less, or 1 mol % or less; and/or the natural gas feed stream may be lean in aliphatic hydrocarbons having from 2 to 5 carbon atoms in total, such as for example where the total concentration of any and all C2-C5 hydrocarbons in the feed stream (i.e. the concentration of any and all C2-C5 hydrocarbons in the feed stream when taken together) is 10 mol % or less, or 5 mol % or less, or 4 mol % or less. Likewise, the natural gas feed stream may, alternatively or additionally, have a relatively high concentration of heavy hydrocarbons, such as where the natural gas feed stream has a total concentration of heavy hydrocarbon components of 100 ppm or more, or 250 ppm or more (i.e. the concentration of all aromatics and C6+ aliphatic hydrocarbons in the feed stream, taken together, totals 100 ppm or more, or 250 ppm or more).

In certain preferred embodiments, the method further comprises liquefying at least a portion of the natural gas stream lean in heavy hydrocarbons to produce a liquefied natural gas stream.

In preferred embodiments, the composition of the natural gas stream lean in heavy hydrocarbons is such that any and all heavy hydrocarbons that are still present in said stream are present in said stream at concentrations below (and most preferably well below) their respective solid solubility limits at the temperature of the liquefied natural gas stream.

In one embodiment, the gas-liquid separation system is the first heavy hydrocarbon removal system, and the method comprises the steps of: introducing the natural gas feed stream into the gas-liquid separation system and separating the natural gas feed stream into a heavy hydrocarbon depleted natural gas vapor stream and a heavy hydrocarbon enriched liquid stream; and passing at least a portion of the heavy hydrocarbon depleted natural gas vapor stream through the one or more beds of the adsorption system to adsorb heavy hydrocarbons therefrom, thereby producing the natural gas stream lean in heavy hydrocarbons. The method may further comprise cooling the natural gas feed stream prior to said stream being introduced into gas-liquid separation system, and warming the heavy hydrocarbon depleted natural gas vapor stream prior to said stream or portion thereof being passed through the one or more beds of the adsorption system, wherein the natural gas feed stream is cooled and the heavy hydrocarbon depleted natural gas vapor stream is warmed in an economizer heat exchanger via indirect heat exchange between the natural gas feed stream and the heavy hydrocarbon depleted natural gas vapor stream. Alternatively, the method may further comprise warming the heavy hydrocarbon depleted natural gas vapor stream prior to said stream or portion thereof being passed through the one or more beds of the adsorption system, and cooling at least a portion of the natural gas stream lean in heavy hydrocarbons to produce a cooled natural gas stream lean in heavy hydrocarbons, wherein the heavy hydrocarbon depleted natural gas vapor stream is warmed and the at least a portion of the natural gas stream lean in heavy hydrocarbons is cooled in an economizer heat exchanger via indirect heat exchange between the heavy hydrocarbon depleted natural gas vapor stream and the at least a portion of the natural gas stream lean in heavy hydrocarbons.

In an alternative embodiment, the adsorption system is the first heavy hydrocarbon removal system, and the method comprises the steps of: passing the natural gas feed stream through the one or more beds of the adsorption system to adsorb heavy hydrocarbons therefrom, thereby producing a heavy hydrocarbon depleted natural gas stream; and introducing at least a portion of the heavy hydrocarbon depleted natural gas stream into the gas-liquid separation system and separating said stream or portion thereof into a natural gas vapor stream that is further depleted in heavy hydrocarbons, thereby providing the natural gas stream lean in heavy hydrocarbons, and a heavy hydrocarbon enriched liquid stream.

According to a second aspect of the present invention, there is provided an apparatus for removing heavy hydrocarbons from a natural gas feed stream, the apparatus comprising a first heavy hydrocarbon removal system and a second heavy hydrocarbon removal system for processing the natural gas feed stream to produce a natural gas stream lean in heavy hydrocarbons, wherein said first and second systems are connected in fluid flow communication with each other and are arranged in series such that in use the first system processes the natural gas feed stream to produce a heavy hydrocarbon depleted natural gas stream and the second system processes at least a portion of the heavy hydrocarbon depleted natural gas stream from the first system to produce the natural gas stream lean in heavy hydrocarbons, and wherein one of said systems is an adsorption system comprising one or more beds of adsorbent for adsorbing and thereby removing heavy hydrocarbons from a heavy hydrocarbon containing natural gas, and the other of said systems is a gas-liquid separation system for separating a heavy hydrocarbon containing natural gas into a heavy hydrocarbon depleted natural gas vapor and a heavy hydrocarbon enriched liquid.

The apparatus according to the second aspect of the invention is suitable for carrying out the method according to the first aspect of the invention. Preferred embodiments of the apparatus according to the second aspect will therefore be apparent from the above discussion of preferred embodiments of the method according to the first aspect. In particular:

Preferably, the gas-liquid separation system comprises a stripping column or a phase separator.

Preferably, the adsorption system comprises a temperature swing adsorption system.

Preferably, the apparatus further comprises a liquefier connected in fluid flow communication with the second heavy hydrocarbon removal system for receiving and liquefying at least a portion of the natural gas stream lean in heavy hydrocarbons to produce a liquefied natural gas stream.

In one embodiment, the gas-liquid separation system is the first heavy hydrocarbon removal system, and the apparatus comprises: a gas-liquid separation system for receiving and separating the natural gas feed stream into a heavy hydrocarbon depleted natural gas vapor stream and a heavy hydrocarbon enriched liquid stream; and an adsorption system, in fluid flow communication with the gas-liquid separation system, for receiving at least a portion of the heavy hydrocarbon depleted natural gas vapor stream, and comprising one or more beds of adsorbent for adsorbing heavy hydrocarbons from said at least a portion of the heavy hydrocarbon depleted natural gas vapor stream, to thereby produce the natural gas stream lean in heavy hydrocarbons. The apparatus may further comprise an economizer heat exchanger for cooling the natural gas feed stream, prior to said stream being introduced into gas-liquid separation system, and warming the heavy hydrocarbon depleted natural gas vapor stream, prior to said stream or portion thereof being passed through the one or more beds of the adsorption system, via indirect heat exchange between the natural gas feed stream and the heavy hydrocarbon depleted natural gas vapor stream. Alternatively, the apparatus may further comprise an economizer heat exchanger for warming the heavy hydrocarbon depleted natural gas vapor stream, prior to said stream or portion thereof being passed through the one or more beds of the adsorption system, and cooling at least a portion of the natural gas stream lean in heavy hydrocarbons via indirect heat exchange between the heavy hydrocarbon depleted natural gas vapor stream and the at least a portion of the natural gas stream lean in heavy hydrocarbons.

In an alternative embodiment, the adsorption system is the first heavy hydrocarbon removal system, and the apparatus comprises: an adsorption system for receiving the natural gas feed stream, and comprising one or more beds of adsorbent for adsorbing heavy hydrocarbons from the natural gas feed stream, to thereby produce a heavy hydrocarbon depleted natural gas stream; and a gas-liquid separation system, in fluid flow communication with the adsorption system, for receiving at least a portion of the heavy hydrocarbon depleted natural gas stream and separating said stream or portion thereof into a heavy hydrocarbon enriched liquid stream and a natural gas vapor stream that is further depleted in heavy hydrocarbons, the latter providing the natural gas stream lean in heavy hydrocarbons.

According to a third aspect of the present invention, there is provided a method for removing heavy hydrocarbons from and liquefying a natural gas stream, the method comprising: passing the natural gas stream through an adsorption system that comprises one or more beds of adsorbent for adsorbing and thereby removing heavy hydrocarbons from the natural gas stream, to thereby provide a natural gas stream depleted in heavy hydrocarbons; liquefying the natural gas stream depleted in heavy hydrocarbons to produce a liquefied natural gas stream; and regenerating the one or more beds of the temperature swing adsorption system by passing a flash or boil off gas obtained from the liquefied natural gas through the one or more beds. Preferably the adsorption system is a temperature swing adsorption system, the temperature of the one or more beds during regeneration being higher than the temperature of the one or more beds during adsorption of heavy hydrocarbons from the natural gas stream.

Preferred aspects of the present invention include the following aspects, numbered #1 to #33:

#1. A method of removing heavy hydrocarbons from a natural gas feed stream, the method comprising the steps of using a first heavy hydrocarbon removal system and a second heavy hydrocarbon removal system to process the natural gas feed stream to produce a natural gas stream lean in heavy hydrocarbons, wherein said first and second systems are used in series such that the first system processes the natural gas feed stream to produce a heavy hydrocarbon depleted natural gas stream and the second system processes at least a portion of the heavy hydrocarbon depleted natural gas stream from the first system to produce the natural gas stream lean in heavy hydrocarbons, and wherein one of said systems is an adsorption system that comprises one or more beds of adsorbent for adsorbing and thereby removing heavy hydrocarbons from a heavy hydrocarbon containing natural gas, and the other of said systems is a gas-liquid separation system for separating a heavy hydrocarbon containing natural gas into a heavy hydrocarbon depleted natural gas vapor and a heavy hydrocarbon enriched liquid.

#2. The method of Aspect #1, wherein the gas-liquid separation system comprises a stripping column or a phase separator.

#3. The method of Aspect #1 or #2, wherein the method is further a method of producing a liquefied natural gas stream, and further comprises liquefying at least a portion of the natural gas stream lean in heavy hydrocarbons to produce the liquefied natural gas stream.

#4. The method of any one of Aspects #1 to #3, wherein the gas-liquid separation system is the first heavy hydrocarbon removal system, the method comprising the steps of:

introducing the natural gas feed stream into the gas-liquid separation system and separating the natural gas feed stream into a heavy hydrocarbon depleted natural gas vapor stream and a heavy hydrocarbon enriched liquid stream; and passing at least a portion of the heavy hydrocarbon depleted natural gas vapor stream through the one or more beds of the adsorption system to adsorb heavy hydrocarbons therefrom, thereby producing the natural gas stream lean in heavy hydrocarbons.

#5. The method of Aspect #4, wherein the method further comprises cooling the natural gas feed stream prior to said stream being introduced into gas-liquid separation system, and warming the heavy hydrocarbon depleted natural gas vapor stream prior to said stream or portion thereof being passed through the one or more beds of the adsorption system.

#6. The method of Aspect #5, wherein the natural gas feed stream is cooled and the heavy hydrocarbon depleted natural gas vapor stream is warmed in an economizer heat exchanger via indirect heat exchange between the natural gas feed stream and the heavy hydrocarbon depleted natural gas vapor stream.

#7. The method of Aspect #6, wherein the natural gas feed stream is further cooled prior to being introduced into gas-liquid separation system via expansion of the natural gas feed stream and/or via direct or indirect heat exchange with one or more other streams.

#8. The method of Aspect #6 or #7, wherein the method further comprises liquefying at least a portion of the natural gas stream lean in heavy hydrocarbons.

#9. The method of Aspect #5, wherein the method further comprises cooling at least a portion of the natural gas stream lean in heavy hydrocarbons to produce a cooled natural gas stream lean in heavy hydrocarbons, and wherein the heavy hydrocarbon depleted natural gas vapor stream is warmed and the at least a portion of the natural gas stream lean in heavy hydrocarbons is cooled in an economizer heat exchanger via indirect heat exchange between the heavy hydrocarbon depleted natural gas vapor stream and the at least a portion of the natural gas stream lean in heavy hydrocarbons.

#10. The method of Aspect #9, wherein the method further comprises liquefying the cooled natural gas stream lean in heavy hydrocarbons.

#11. The method of Aspect #10, wherein the natural gas feed stream is cooled and the cooled natural gas stream lean in heavy hydrocarbons is liquefied in a liquefier, the natural gas feed stream being introduced into a warm end of the liquefier and withdrawn from an intermediate location of the liquefier, and the cooled natural gas stream lean in heavy hydrocarbons being introduced into an intermediate location of the liquefier and withdrawn from a cold end of the liquefier.

#12. The method of any one of Aspects #4 to #11, wherein the gas-liquid separation system is a stripping column, the method further comprising introducing a stripping gas into the stripping column at a location below the location at which the natural gas feed stream is introduced into the stripping column.

#13. The method of any one of Aspects #6 to #8, wherein the gas liquid separation system is a stripping column, the method further comprising introducing a stripping gas into the stripping column at a location below the location at which the natural gas feed stream is introduced into the stripping column, and wherein the stripping gas comprises one or more gases selected from the group consisting of: natural gas taken from the natural gas feed stream prior to said stream being cooled and introduced into the stripping column; a portion of the natural gas stream depleted in heavy hydrocarbons that has been warmed in the economiser heat exchanger; a portion of the natural gas stream lean in heavy hydrocarbons; a gas obtained from re-boiling all or a portion of the heavy hydrocarbon enriched liquid stream; and a flash or boil-off gas obtained from a liquefied natural gas.

#14. The method of any one of Aspects #9 to #11, wherein the gas liquid separation system is a stripping column, the method further comprising introducing a stripping gas into the stripping column at a location below the location at which the natural gas feed stream is introduced into the stripping column, and wherein the stripping gas comprises one or more gases selected from the group consisting of: natural gas taken from the natural gas feed stream prior to said stream being cooled and introduced into the stripping column; a portion of the natural gas stream lean in heavy hydrocarbons that is not cooled in the economizer heat exchanger; a portion of the natural gas stream depleted in heavy hydrocarbons that has been warmed in the economiser heat exchanger; a gas obtained from re-boiling all or a portion of the heavy hydrocarbon enriched liquid stream; and a flash or boil-off gas obtained from a liquefied natural gas.

#15. The method of any one of Aspects #4 to #14, wherein the adsorption system is a temperature swing adsorption system, and the method further comprises regenerating the one or more beds of the temperature swing adsorption system by passing a gas, selected from a portion of the natural gas stream lean in heavy hydrocarbons or a flash or boil off gas obtained from a liquefied natural gas, through the one or more beds, the temperature of the one or more beds during regeneration being higher than the temperature of the one or more beds during adsorption of heavy hydrocarbons from the heavy hydrocarbon depleted natural gas vapor stream or portion thereof.

#16. The method of Aspect #15, wherein the method further comprises cooling and separating into liquid and vapor phases the gas obtained from the one or more beds of the temperature swing adsorption system during regeneration of said one or more beds, and recycling the vapor phase into the natural gas feed stream prior to the introduction thereof into the gas-liquid separation system.

#17. The method of Aspect #15, wherein the gas liquid separation system is a stripping column, and the method further comprises cooling and separating into liquid and vapor phases the gas obtained from the one or more beds of the temperature swing adsorption system during regeneration of said one or more beds, and introducing the vapor phase as a stripping gas into the stripping column at a location below the location at which the natural gas feed stream is introduced into the stripping column.

#18. The method of any one of Aspects #1 to #3, wherein the adsorption system is the first heavy hydrocarbon removal system, the method comprising the steps of:

passing the natural gas feed stream through the one or more beds of the adsorption system to adsorb heavy hydrocarbons therefrom, thereby producing a heavy hydrocarbon depleted natural gas stream; and introducing at least a portion of the heavy hydrocarbon depleted natural gas stream into the gas-liquid separation system and separating said stream or portion thereof into a natural gas vapor stream that is further depleted in heavy hydrocarbons, thereby providing the natural gas stream lean in heavy hydrocarbons, and a heavy hydrocarbon enriched liquid stream.

#19. The method of Aspect #18, wherein the method further comprises cooling the heavy hydrocarbon depleted natural gas stream or portion thereof introduced into gas-liquid separation system prior to said stream or portion thereof being introduced into gas-liquid separation system.

#20. The method of Aspect #19, wherein the method further comprises liquefying the natural gas stream lean in heavy hydrocarbons.

#21. The method of Aspect #20, wherein the heavy hydrocarbon depleted natural gas stream or portion thereof is cooled and the natural gas stream lean in heavy hydrocarbons is liquefied in a liquefier, the heavy hydrocarbon depleted natural gas stream or portion thereof being introduced into a warm end of the liquefier and withdrawn from an intermediate location of the liquefier, and the natural gas stream lean in heavy hydrocarbons being introduced into an intermediate location of the liquefier and withdrawn from a cold end of the liquefier.

#22. The method of any one of Aspects #18 to #21, wherein the gas liquid separation system is a stripping column, the method further comprising introducing a stripping gas into the stripping column at a location below the location at which the heavy hydrocarbon depleted natural gas stream or portion thereof is introduced into the stripping column.

#23. The method of Aspect #22, wherein the stripping gas comprises one or more gases selected from the group consisting of: natural gas taken from the natural gas feed stream prior to said stream being passed through the one or more beds of the adsorption system; a portion of the heavy hydrocarbon depleted natural gas stream; a gas obtained from re-boiling all or a portion of the heavy hydrocarbon enriched liquid stream; and a flash or boil-off gas obtained from a liquefied natural gas.

#24. The method of any one of Aspects #18 to #23, wherein the adsorption system is a temperature swing adsorption system, and the method further comprises regenerating the one or more beds of the temperature swing adsorption system by passing a gas, selected from a portion of the heavy hydrocarbon depleted natural gas stream or a flash or boil off gas obtained from a liquefied natural gas, through the one or more beds, the temperature of the one or more beds during regeneration being higher than the temperature of the one or more beds during adsorption of heavy hydrocarbons from the natural gas feed stream.

#25. The method of Aspect #24, wherein the method further comprises cooling and separating into liquid and vapor phases the gas obtained from the one or more beds of the temperature swing adsorption system during regeneration of said one or more beds, and recycling the vapor phase into the natural gas feed stream prior to said stream being passed through the one or more beds of the temperature swing adsorption system.

#26. The method of Aspect #24, wherein the gas liquid separation system is a stripping column, and the method further comprises introducing a stripping gas into the stripping column at a location below the location at which the heavy hydrocarbon depleted natural gas stream or portion thereof is introduced into the stripping column, wherein said stripping gas comprises: the gas obtained from the one or more beds of the temperature swing adsorption system during regeneration of said one or more beds; or the vapor phase obtained from cooling and separating into liquid and vapor phases the gas obtained from the one or more beds of the temperature swing adsorption system during regeneration of said one or more beds.

#27. The method of any one of Aspects #1 to #26, wherein the natural gas feed stream is lean in aliphatic hydrocarbons having from 3 to 5 carbon atoms in total, and/or is lean in aliphatic hydrocarbons having from 2 to 5 carbon atoms in total.

#28. An apparatus for removing heavy hydrocarbons from a natural gas feed stream, the apparatus comprising a first heavy hydrocarbon removal system and a second heavy hydrocarbon removal system for processing the natural gas feed stream to produce a natural gas stream lean in heavy hydrocarbons, wherein said first and second systems are connected in fluid flow communication with each other and are arranged in series such that in use the first system processes the natural gas feed stream to produce a heavy hydrocarbon depleted natural gas stream and the second system processes at least a portion of the heavy hydrocarbon depleted natural gas stream from the first system to produce the natural gas stream lean in heavy hydrocarbons, and wherein one of said systems is an adsorption system comprising one or more beds of adsorbent for adsorbing and thereby removing heavy hydrocarbons from a heavy hydrocarbon containing natural gas, and the other of said systems is a gas-liquid separation system for separating a heavy hydrocarbon containing natural gas into a heavy hydrocarbon depleted natural gas vapor and a heavy hydrocarbon enriched liquid.

#29. An apparatus according to Aspect #28, wherein the gas-liquid separation system comprises a stripping column or a phase separator.

#30. An apparatus according to Aspect #28 or #29, wherein the apparatus is further for producing a liquefied natural gas stream, and further comprises a liquefier connected in fluid flow communication with the second heavy hydrocarbon removal system for receiving and liquefying at least a portion of the natural gas stream lean in heavy hydrocarbons to produce the liquefied natural gas stream.

#31. An apparatus according any one of Aspects #28 to #30, wherein the gas-liquid separation system is the first heavy hydrocarbon removal system, the apparatus comprising:

a gas-liquid separation system for receiving and separating the natural gas feed stream into a heavy hydrocarbon depleted natural gas vapor stream and a heavy hydrocarbon enriched liquid stream;

an adsorption system, in fluid flow communication with the gas-liquid separation system, for receiving at least a portion of the heavy hydrocarbon depleted natural gas vapor stream, and comprising one or more beds of adsorbent for adsorbing heavy hydrocarbons from said at least a portion of the heavy hydrocarbon depleted natural gas vapor stream, to thereby produce the natural gas stream lean in heavy hydrocarbons; and an economizer heat exchanger for cooling the natural gas feed stream, prior to said stream being introduced into gas-liquid separation system, and warming the heavy hydrocarbon depleted natural gas vapor stream, prior to said stream or portion thereof being passed through the one or more beds of the adsorption system, via indirect heat exchange between the natural gas feed stream and the heavy hydrocarbon depleted natural gas vapor stream.

#32. An apparatus according to any one of Aspects #28 to #30, wherein the gas-liquid separation system is the first heavy hydrocarbon removal system, the apparatus comprising:

a gas-liquid separation system for receiving and separating the natural gas feed stream into a heavy hydrocarbon depleted natural gas vapor stream and a heavy hydrocarbon enriched liquid stream;

an adsorption system, in fluid flow communication with the gas-liquid separation system, for receiving at least a portion of the heavy hydrocarbon depleted natural gas vapor stream, and comprising one or more beds of adsorbent for adsorbing heavy hydrocarbons from said at least a portion of the heavy hydrocarbon depleted natural gas vapor stream, to thereby produce the natural gas stream lean in heavy hydrocarbons; and an economizer heat exchanger for warming the heavy hydrocarbon depleted natural gas vapor stream, prior to said stream or portion thereof being passed through the one or more beds of the adsorption system, and cooling at least a portion of the natural gas stream lean in heavy hydrocarbons via indirect heat exchange between the heavy hydrocarbon depleted natural gas vapor stream and the at least a portion of the natural gas stream lean in heavy hydrocarbons.

#33. An apparatus according to any one of Aspects #28 to #30, wherein the adsorption system is the first heavy hydrocarbon removal system, the apparatus comprising:

an adsorption system for receiving the natural gas feed stream, and comprising one or more beds of adsorbent for adsorbing heavy hydrocarbons from the natural gas feed stream, to thereby produce a heavy hydrocarbon depleted natural gas stream; and a gas-liquid separation system, in fluid flow communication with the adsorption system, for receiving at least a portion of the heavy hydrocarbon depleted natural gas stream and separating said stream or portion thereof into a heavy hydrocarbon enriched liquid stream and a natural gas vapor stream that is further depleted in heavy hydrocarbons, the latter providing the natural gas stream lean in heavy hydrocarbons.

DETAILED DESCRIPTION

Figure 1A:
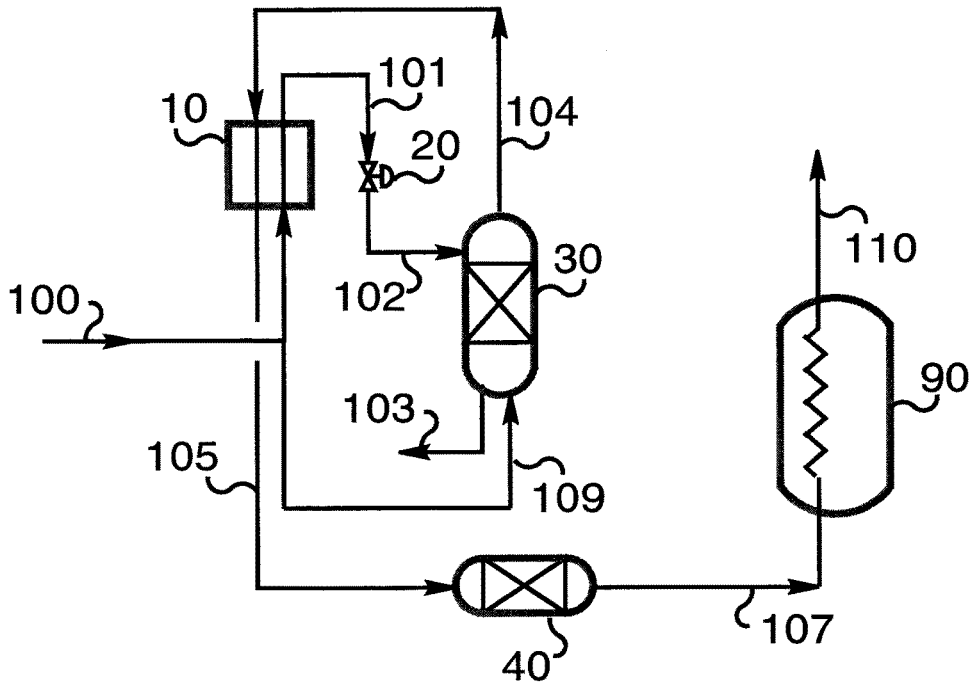
FIGS. 1(*a*) to (*f*) depict a first set of embodiments of the present invention, in which a gas-liquid separation system is used and arranged upstream of and in series with an adsorption system in order to remove heavy hydrocarbons from a natural gas feed stream.
Figure 1B:
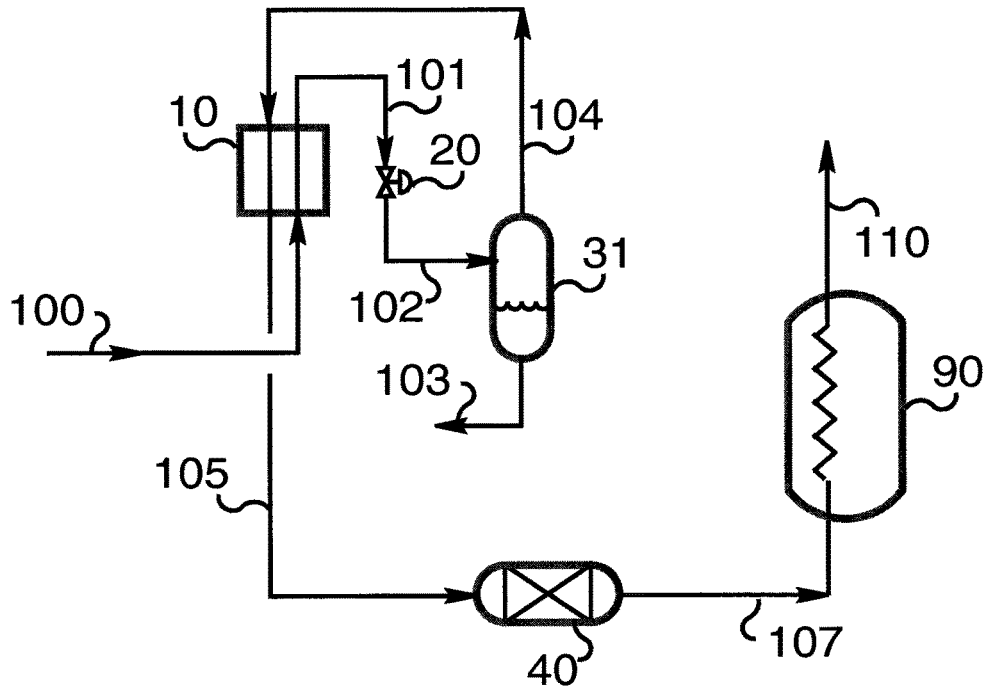
Figure 1C:
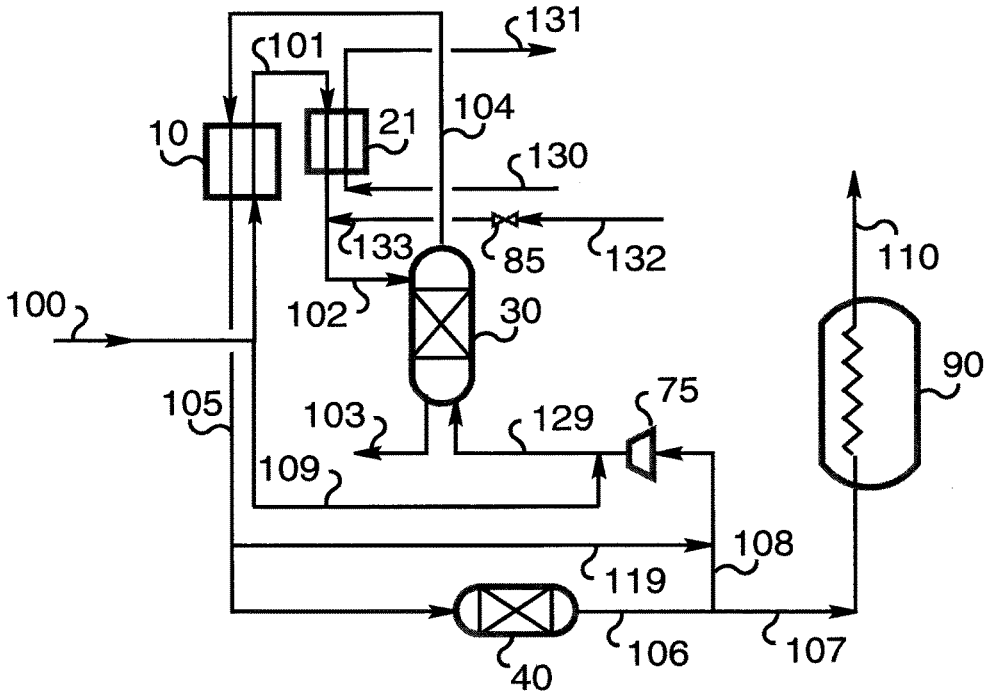
Figure 1D:
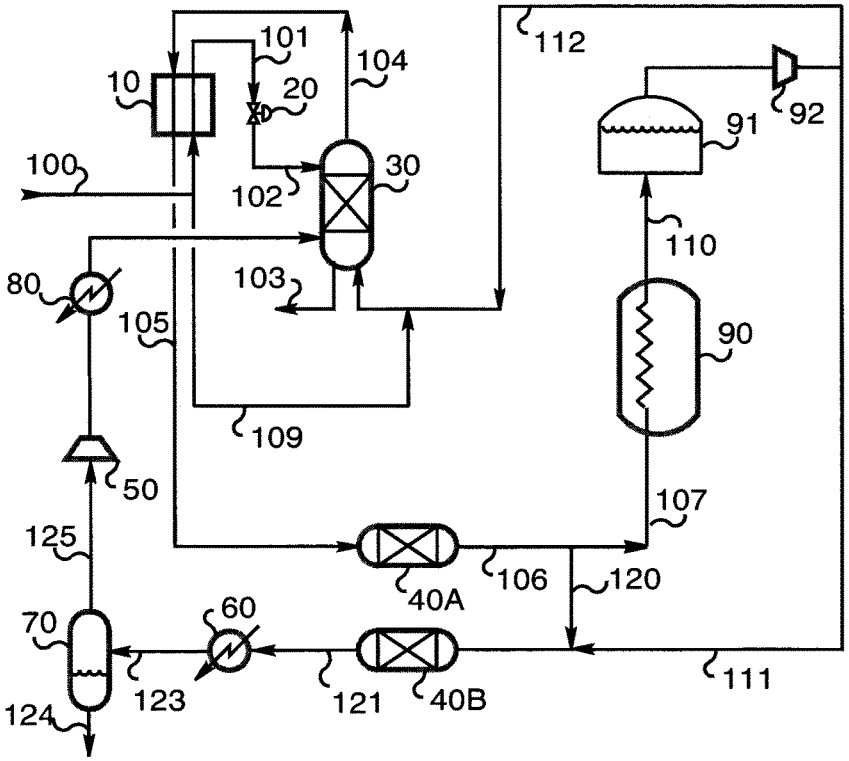
Figure 1E:
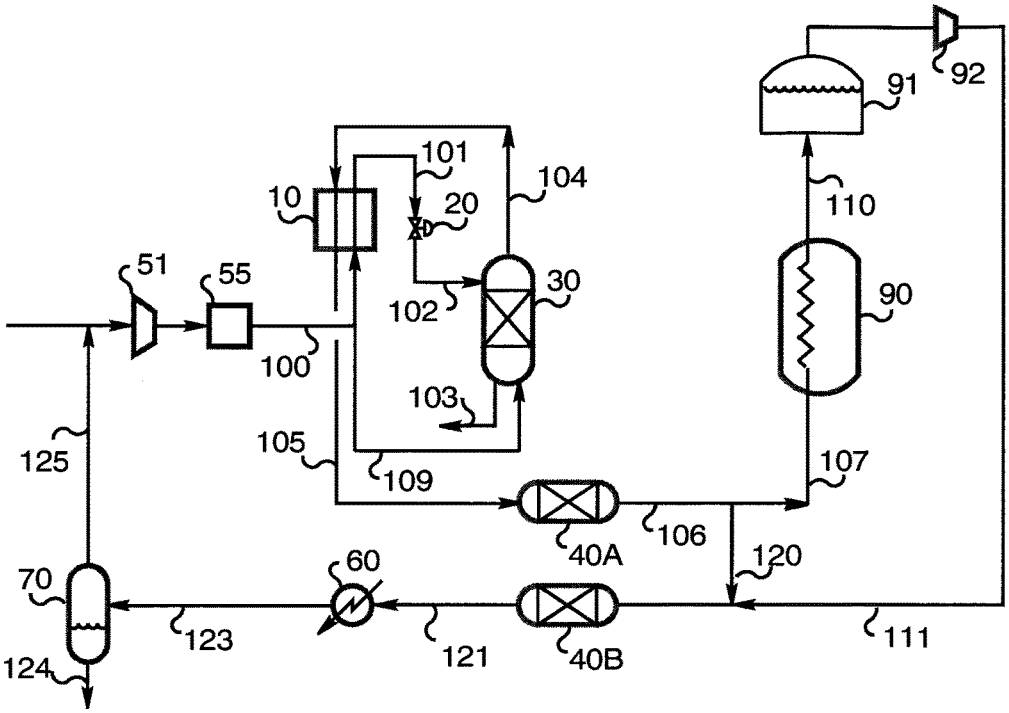
Figure 1F:
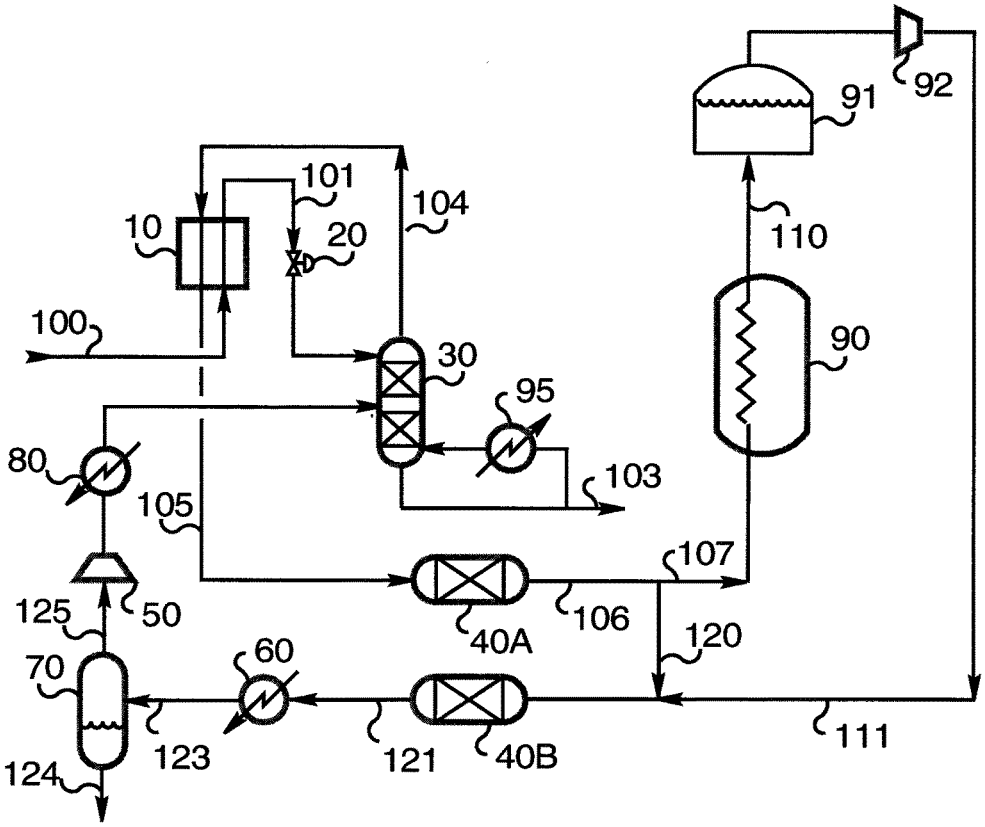
Figure 2A:
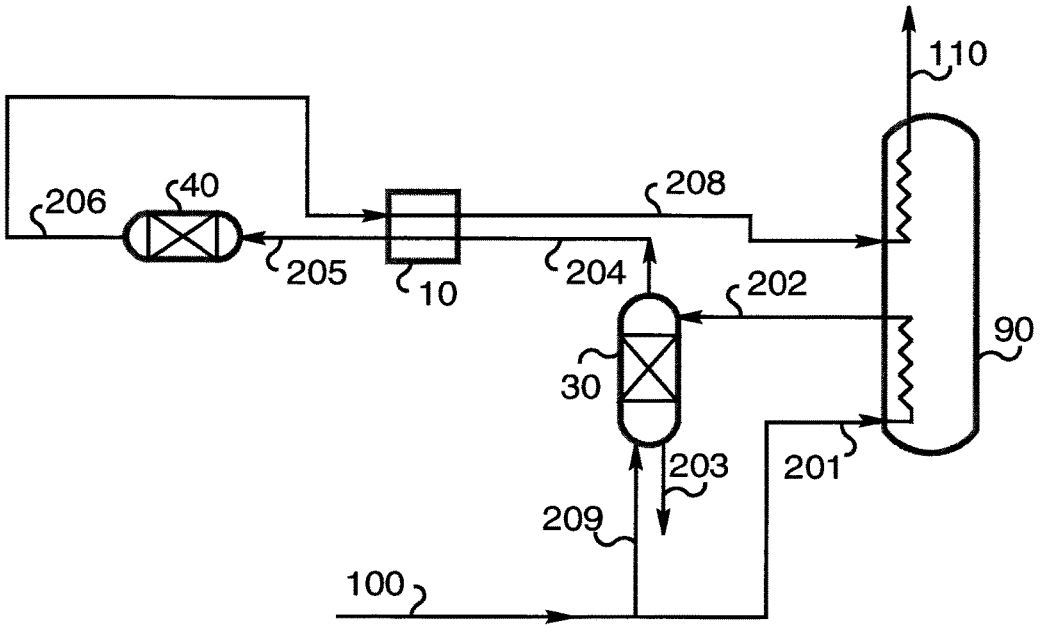
FIGS. 2(*a*) to (*d*) depict a second set of embodiments of the present invention, in which a gas-liquid separation system is used and arranged upstream of and in series with an adsorption system in order to remove heavy hydrocarbons from a natural gas feed stream.
Figure 2B:
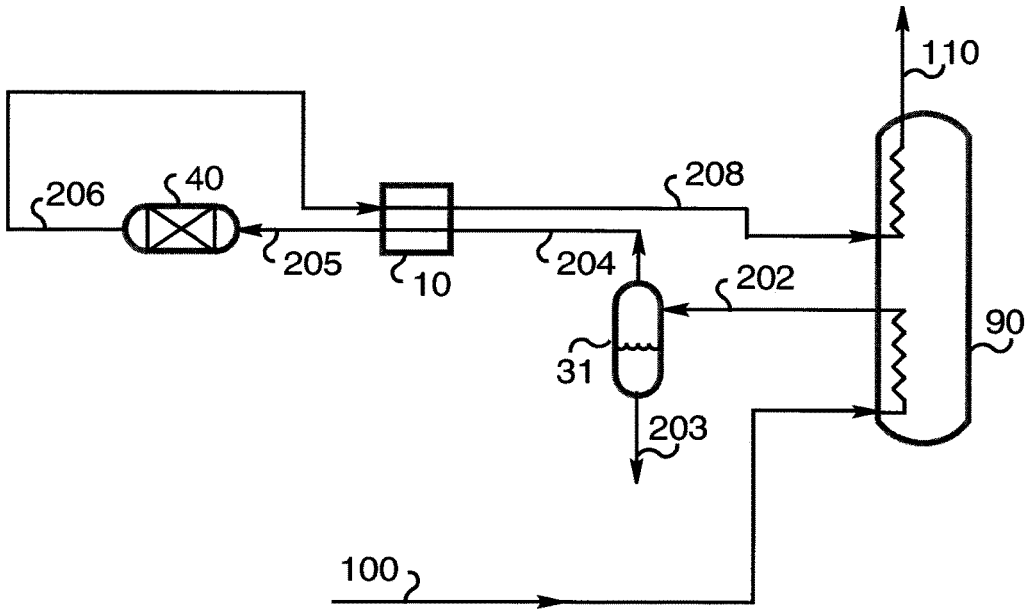
Figure 2C:
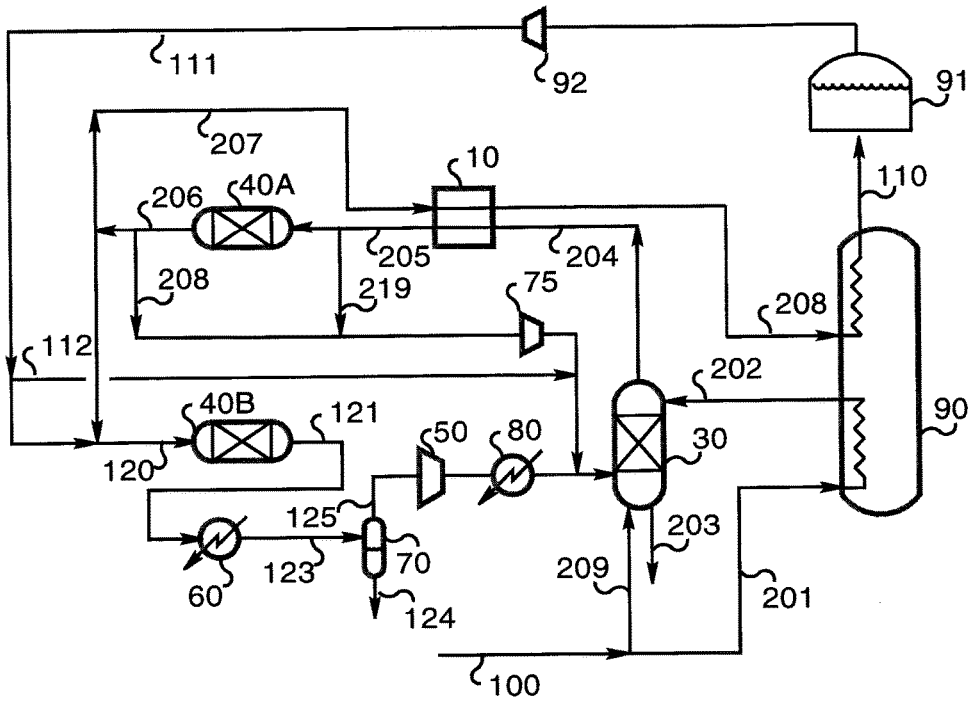
Figure 2D:
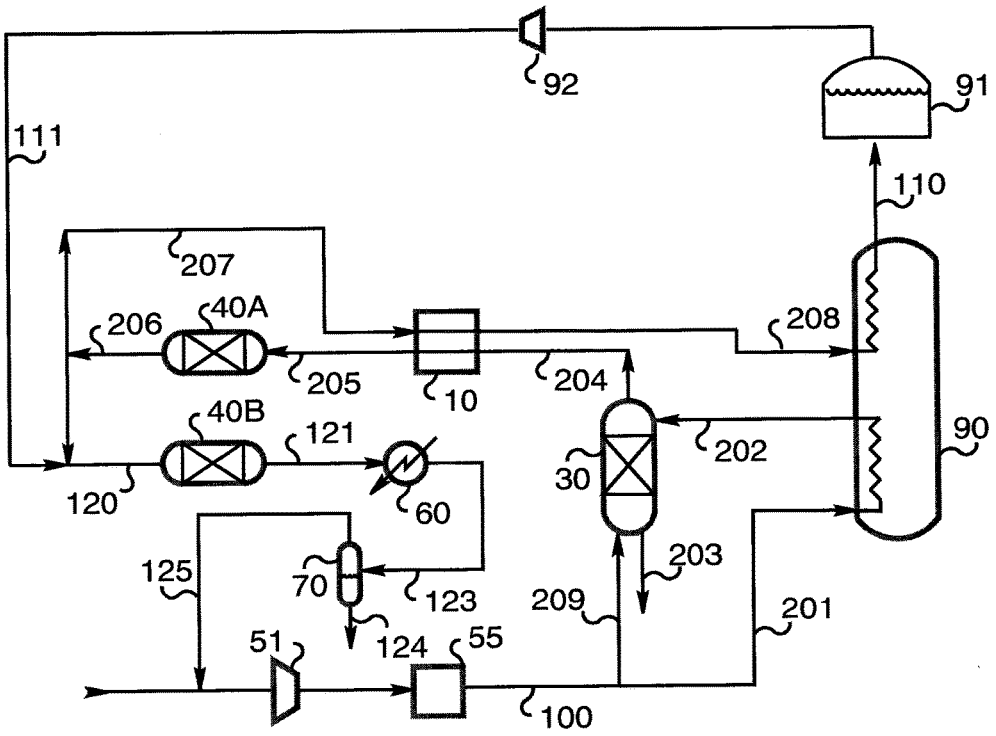
Figure 3A:
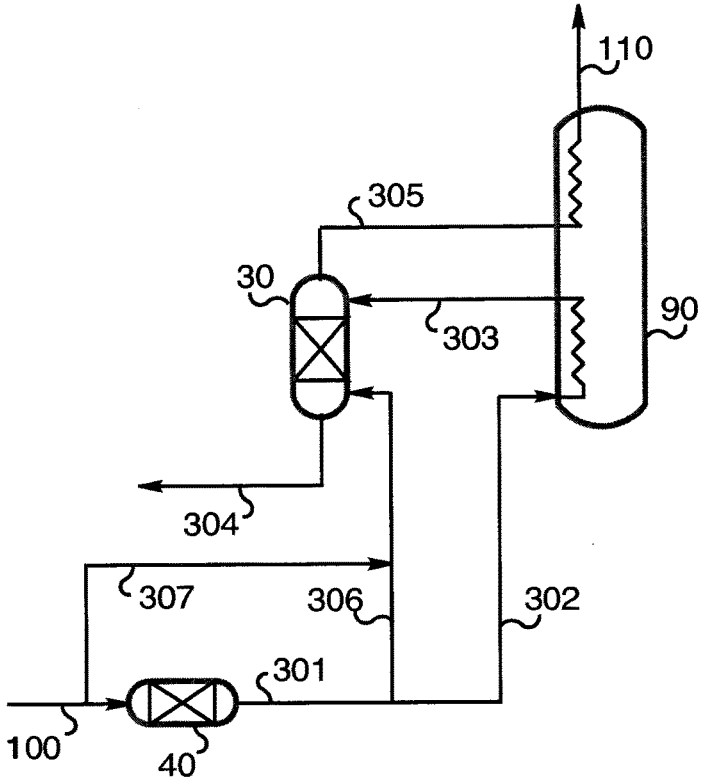
FIGS. 3(*a*) to (*d*) depict a third set of embodiments of the present invention, in which an adsorption system is used and arranged upstream of and in series with a gas-liquid separation system in order to remove heavy hydrocarbons from a natural gas feed stream.
Figure 3B:
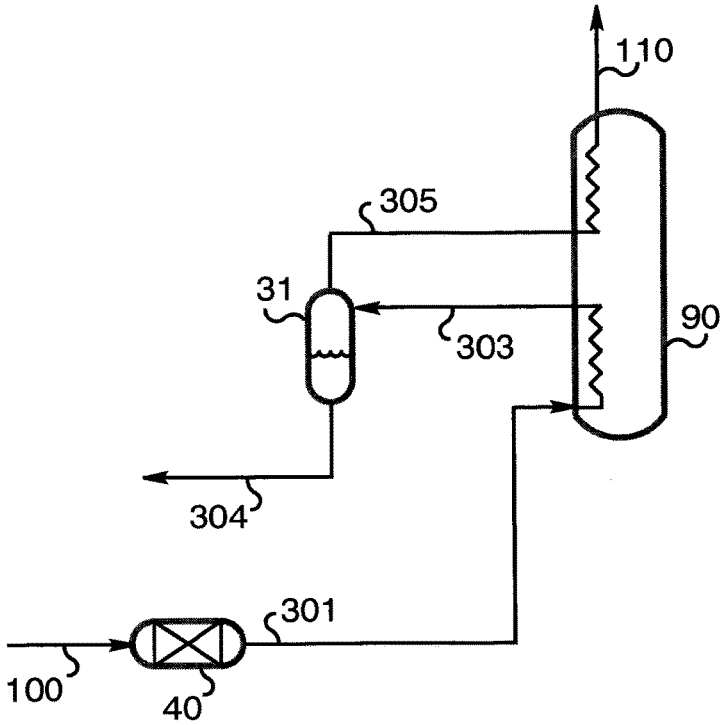
Figure 3C:
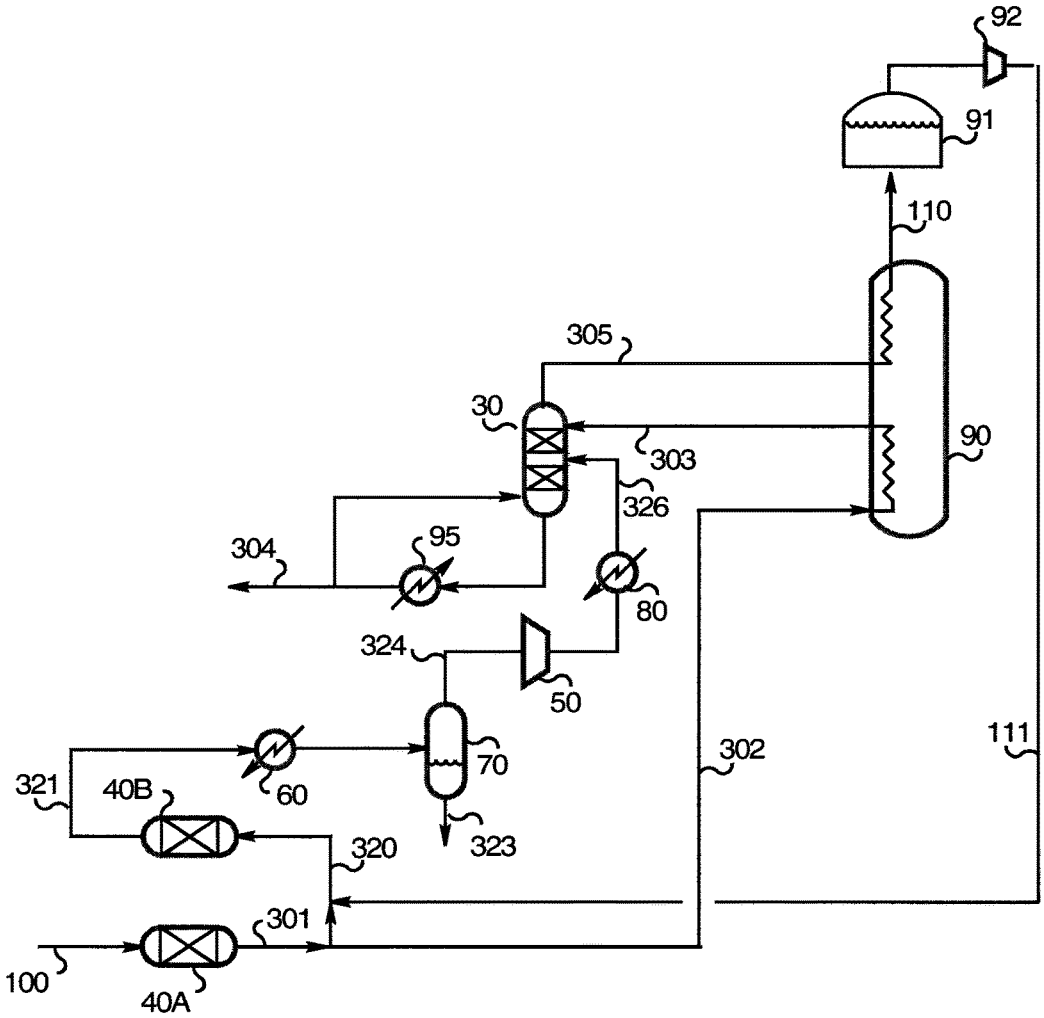
Figure 3D:
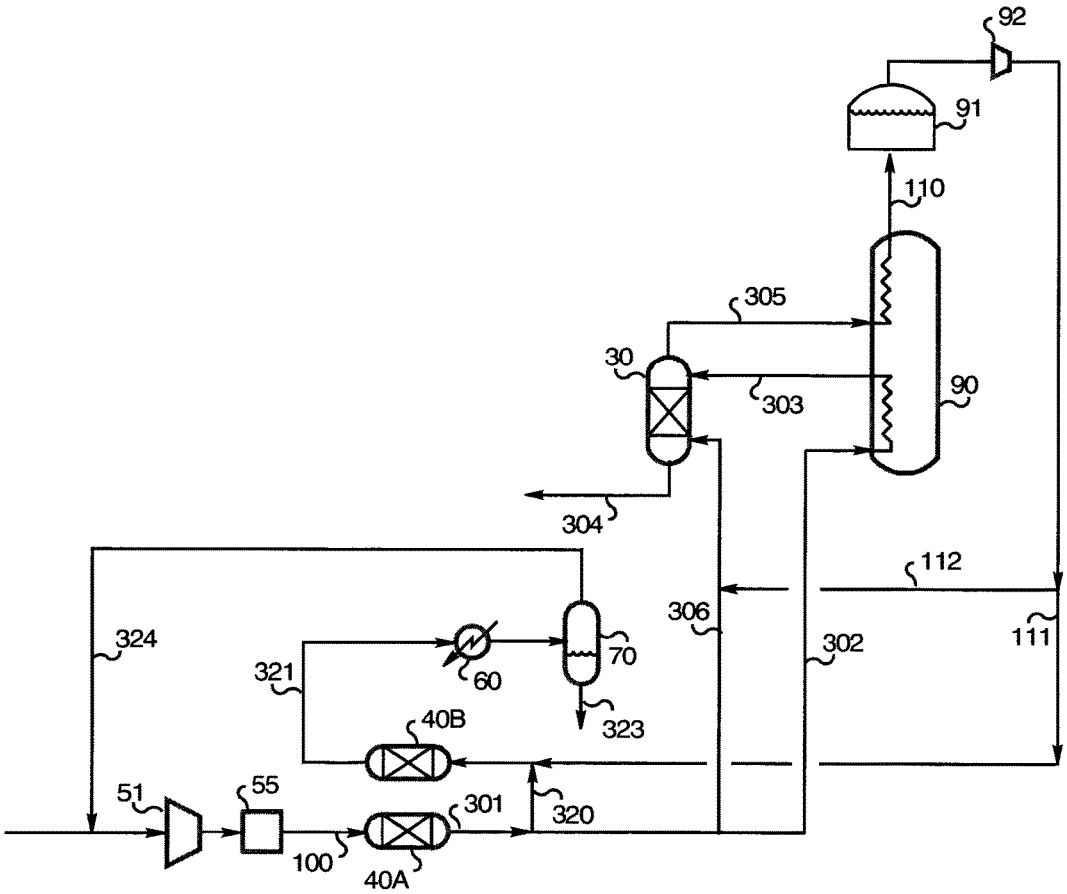

In certain aspects, the present invention concerns a method and apparatus in which an adsorption system is used in combination with a gas-liquid separation system so as to effectively remove heavy hydrocarbons (i.e. one or more C6+ hydrocarbons and/or aromatics) from a natural gas stream.

When the natural gas stream has a composition that is lean in C3-C5 components and/or lean in C2-C5 components, and contains relatively high levels of heavy hydrocarbons, any heavy hydrocarbon removal scheme employing a TSA system or scrub column alone is ineffective or energy inefficient. The inventors have found that this problem can be solved by using an adsorption system (preferably a TSA system) in combination with a gas-liquid separation system (preferably comprising a phase separator or a stripping column).

In particular, the method and apparatus according to the present invention can improve the energy efficiency of the liquefaction process by allowing a phase separator or stripping column (or other gas-liquid separation system) to be operated at a higher pressure than a conventional scrub column.

In addition, when a LNG production plant has natural gas feeds from different gas fields or that are contaminated with heavy components, the LNG plant faces the challenge of uncertain levels of heavy hydrocarbons. The method and apparatus according to the present invention can prevent the LNG plant from having freezing problems within a wide range of heavy hydrocarbon concentrations, thus offering the plant operational flexibility when dealing with uncertain or changing gas compositions.

Furthermore, in the method and apparatus according to the present invention the load on the adsorption beds of the TSA (or other adsorption) system is reduced due to the fact that some of the heavy hydrocarbons are removed in the gas-liquid separation system, which lessens the risk of heavy hydrocarbon cracking occurring in the bed or beds of the TSA system during high temperature (e.g. 450-600° F., 232-315° C.) regeneration of said bed or beds, which cracking can otherwise result in bed deactivation.

In the present method and apparatus, the adsorption system and the gas-liquid separation system are used in series to process the natural gas stream to remove heavy hydrocarbons therefrom.

The adsorption system can be placed downstream of the gas-liquid separation system, such that the gas-liquid separation system removes the bulk of the heavy hydrocarbons and controls the amount of heavy hydrocarbons at the inlet of the adsorption system, the adsorption system then removing the rest of the heavy hydrocarbons to the levels necessary or acceptable for preventing subsequent freezing during liquefaction of the natural gas.

Alternatively, the adsorption system can be placed upstream of the gas-liquid separation system, such that the adsorption system removes most of the heavy hydrocarbons, and the gas-liquid separation system removes the remainder of the heavy hydrocarbons to the levels necessary or acceptable for preventing subsequent freezing during liquefaction of the natural gas. The composition of the natural gas stream to the gas-liquid separation system is, in this case, controlled by the adsorption system design and capacity.

The adsorption system and gas-liquid separation system can be installed as a front-end heavy hydrocarbon removal unit that processes the natural gas before the natural gas stream enters a separate liquefaction unit. Alternatively, the adsorption system and gas-liquid separation system can be integrated into a liquefaction unit.

Typically (and depending in part on factors such as the starting temperature of the natural gas stream and whether the gas-liquid separation system is upstream or downstream of the adsorption system) the gas-liquid separation system will require refrigeration to partially condense the stream being fed to the gas-liquid separation system. As will be discussed in further detail below, this refrigeration can be provided in a variety of ways, including but not limited to: refrigeration provided via Joule-Thompson effect (i.e. via isenthalpic, or largely isenthalpic, expansion of the stream); cooling of the stream via indirect heat exchange in a part of the natural gas liquefier; cooling of the stream via indirect heat exchange in another heat exchanger (against another process stream and/or against a separate refrigerant such as, for example, a mixed-refrigerant); or addition of LNG to cool to the stream via direct heat exchange.

Solely by way of example, various preferred embodiments of the invention will now be described with reference to the accompanying drawings, a first group being depicted in FIGS. 1(*a*)-(*f*), a second group being depicted in FIGS. 2(*a*)-(*d*), and a third group being depicted in FIGS. 3(*a*)-(*d*). In the drawings, where a feature is common to more than one drawing that feature has been assigned the same reference numeral in each drawing, for clarity and brevity.

FIGS. 1(*a*)-(*f*)

In a first group of embodiments, depicted in FIGS. 1(*a*)-(*f*), the gas-liquid separation system is upstream of the adsorption system, such that the gas-liquid separation system processes the natural gas feed stream (from which heavy hydrocarbons are to be removed) to produce a heavy hydrocarbon depleted natural gas stream, and the adsorption system processes at least a portion of the heavy hydrocarbon depleted natural gas stream from the gas-liquid separation system to produce the desired natural gas stream lean in heavy hydrocarbons.

More specifically, in the first group of embodiments the natural gas feed stream is cooled in an economizer heat exchanger and then introduced into the gas-liquid separation system and separated into a heavy hydrocarbon depleted natural gas vapor stream and a heavy hydrocarbon enriched liquid stream. The heavy hydrocarbon depleted natural gas vapor stream is then warmed in the economizer heat exchanger, via indirect heat exchange with the natural gas feed stream. The resulting warmed heavy hydrocarbon depleted natural gas vapor stream, or a portion thereof, is then passed through the one or more beds of the adsorption system to adsorb heavy hydrocarbons therefrom and thereby further reduce the concentration of heavy hydrocarbons in said stream or portion thereof (thereby providing the desired natural gas stream lean in heavy hydrocarbons).

Referring now to FIG. 1(*a*), a specific embodiment is shown in which a stripping column and temperature swing adsorption system are used in series to remove heavy hydrocarbons from a natural gas feed stream. A methane rich natural gas feed stream (100) is first passed through an economizer heat exchanger (10), where it is cooled via indirect heat exchange with a heavy hydrocarbon depleted natural gas vapor stream (104), to be described in further detail below. The cooled natural gas feed stream (101) is then further cooled via pressure reduction through a Joule-Thompson (J-T) valve (20). The further cooled and now partially condensed natural gas feed stream (102) is then introduced into a stripping column (30).

The stripping column (30) may be of any suitable design. As is well known in the art, in a stripping column a condensed or partially condensed feed stream (in this case a partially condensed natural gas feed stream) is introduced into the stripping column, where it is brought into contact with a stripping gas. The feed stream is introduced into the stripping column at a location that is above the location at which the stripping gas is introduced, so that the falling stream of liquid from the feed stream comes into counter-current contact with the rising stream of stripping gas, thereby "stripping" said liquid of less volatile components. Typically, the stripping column contains one or more separation stages, positioned between the location at which the feed stream is introduced and the location at which the stripping gas is introduced, and composed of trays, packing, or some other form of insert that acts to increase the amount and/or duration of contact between the feed liquid and stripping gas streams, thereby increasing mass transfer between the streams. Typically, there are no separation stages above the location at which the feed stream is introduced into the stripping column.

In the embodiment depicted in FIG. 1(*a*), the further cooled and partially condensed natural gas feed stream (102) is introduced into the top of the stripping column (30), and a stripping gas (109) is introduced into the bottom of the stripping column, the stripping column comprising one or more separation stages positioned between the feed locations of the natural gas feed stream and stripping gas. The stripping gas for the stripping column may come from any of a variety of different sources, as will be described in further detail with reference to FIG. 1(*c*), but in the particular embodiment depicted in FIG. 1(*a*) it comprises a stream of natural gas (109) taken from the natural gas feed stream (100) upstream of the economizer heat exchanger (10).

The stripping column (30) separates the partially condensed natural gas feed stream (102) into a heavy hydrocarbon depleted natural gas vapor stream (104), that is withdrawn from the top of the stripping column, and a heavy hydrocarbon enriched liquid stream (103), that is removed from the bottom of the stripping column. Optionally, the temperature of the stripping gas (109) entering the stripping column (30) can be adjusted using heater (not shown), if it is desirable to raise the temperature of heavy hydrocarbon enriched liquid stream (103) or reduce the methane content in said stream.

The heavy hydrocarbon depleted natural gas vapor stream (104) withdrawn from the top of the stripping column (30) is then passed, as described above, through the economizer heat exchanger (10) to recover the refrigeration therefrom and to cool down natural gas feed stream (100). The now warmed heavy hydrocarbon depleted natural gas vapor stream (105) from the economizer heat exchanger (10) is then sent to temperature swing adsorption system (40), comprising one or more beds of adsorbent selective for heavy hydrocarbon components of the natural gas stream (i.e. that preferentially adsorb the heavy hydrocarbon components of the stream). Where there are multiple beds these may be arranged in parallel and/or in series. The heavy hydrocarbon depleted natural gas vapor stream (105) is passed through one or more of said beds to further reduce (down to acceptable levels) the concentration of heavy hydrocarbons in said stream and provide the desired natural gas stream lean in heavy hydrocarbons (107).

The natural gas stream lean in heavy hydrocarbons (107) can then be supplied as natural gas feed (107) to a natural gas liquefaction system (90) and liquefied to provide an LNG stream (110). The heavy hydrocarbons adsorbed by the adsorbent(s) can subsequently be removed in an adsorbent regeneration step (not shown in FIG. 1(*a*)).

Referring now to FIG. 1(*b*), in an alternative embodiment a phase separator (31) can be used (in place of the stripping column used in the embodiment depicted in FIG. 1(*a*)) to separate the partially condensed natural gas feed stream (102) into a heavy hydrocarbon depleted natural gas vapor (104), that is withdrawn from the top of the phase separation vessel, and a heavy hydrocarbon enriched liquid (103), that is withdrawn from the bottom of the vessel.

As is known in the art, a phase separator differs from a stripping column in that in a phase separator a partially condensed feed is simply allowed to separate (for example via gravity) into its liquid phase and bulk gas phases, without contact with any additional stripping gases or reflux streams. Thus, in comparison with the stripping column (30) in FIG. 1(*a*), the phase separator (31) in FIG. 1(*b*) contains no separation stages (i.e. trays or packing to enhance mass transfer between countercurrent streams), and no stripping gas is generated and supplied to the phase separator. As compared to the embodiment depicted in FIG. 1(*a*), the embodiment in FIG. 1(*b*) has the advantage of lower capital costs but the disadvantage that it loses more methane in the heavy hydrocarbon enriched liquid stream (103).

As described above, the embodiment depicted in FIG. 1(*a*) (and FIG. 1(*b*)) uses a J-T valve (20) to provide additional refrigeration (i.e. refrigeration additional to that provided by the economiser heat exchanger (10)) for partially condensing the natural gas feed stream (102) to the stripping column (30) (or phase separator (31)). However, other options are additionally or alternatively available. Furthermore, and as noted above, it is also the case that instead of or in addition to using as the stripping gas for the stripping column (30) natural gas (109) taken from the natural gas feed stream (100) upstream of the economizer heat exchanger (10), other sources of stripping gas can also be used. These variations are further illustrated in FIG. 1(*c*).

Accordingly, referring now to FIG. 1(*c*), in other embodiments the additional refrigeration for partially condensing the natural gas feed stream (102) to the stripping column (30) can be provided by another stream that is colder than the cooled natural gas feed stream (101) exiting the economiser heat exchanger (10). For example, the natural gas feed stream may be cooled by indirect heat exchange with a refrigerant stream (130, 131), such as for example a mixed refrigerant stream, in a heat exchanger (21). This heat exchanger may be arranged as a separate unit from the economizer heat exchanger (10) unit and the natural gas liquefier (90) unit, as is shown in FIG. 1(*c*), or it may be combined with one or both of the economizer heat exchanger (10) and natural gas liquefier (90) as a single unit. Alternatively or additionally, the natural gas feed stream may be cooled by direct heat exchange, such as via direct injection of a cold stream (133) into the natural gas stream (101, 102). In the case of direct injection, it is possible that the cold stream (133) is itself obtained from a stream (132) that is further cooled via pressure let down through an J-T valve (82). A suitable source of a cold stream (132, 133) for direct injection into the natural gas feed stream may, for example, be a portion of the LNG obtained from the liquefier (90), the pressure of which has been raised in a liquid pump (not shown).

Likewise, with reference to FIG. 1(*c*), in other embodiments the stripping gas (129) supplied to the stripping column (30) may comprise one or more of: a stream of natural gas (109) taken from the natural gas feed stream (100) upstream of the economizer heat exchanger (10) (as already described in relation to FIG. 1(*a*)); a portion (119) of the warmed natural gas stream depleted in heavy hydrocarbons (105) from the economiser heat exchanger (10); or a portion (108) of the natural gas stream lean in heavy hydrocarbons (106) from the temperature swing adsorption system (40) (in which case only a portion (107) of said natural gas stream lean in heavy hydrocarbons (106) is then sent to the liquefier (90) for liquefaction). Where a portion (119) of the natural gas stream depleted in heavy hydrocarbons (105) and/or a portion (108) of the natural gas stream lean in heavy hydrocarbons (106) are used as the stripping gas (129), these may first require compression in a compressor (75) prior to being used as the stripping gas (129). It is preferred that the stripping gas (or at least some of the stripping gas) is natural gas (109) taken from the natural gas feed stream (100), because the natural gas feed stream is typically at a pressure higher than the pressure at the bottom of the stripping column, and thus natural gas taken from this stream will typically not require any compression in order to be used as the stripping gas.

Referring to FIGS. 1(*d*) and (*e*), in embodiments where a stripping column (30) is used it is also possible to recover through the stripping column some of the gas generated during regeneration of the bed or beds of the adsorption system (40). As shown in FIGS. 1(*d*) and 1(*e*), the adsorption system may for example comprise two, or more, beds in parallel (40A and 40B), wherein while one of the beds (40A) is undergoing the adsorption step, i.e. is adsorbing heavy hydrocarbons from the heavy hydrocarbon depleted natural gas vapor stream (105), the other bed (40B) is being regenerated, regeneration gas being passed through the bed during this regeneration step in order to assist with the desorption and removal from the bed of heavy hydrocarbons adsorbed in a preceding adsorption step (the temperature of the bed during the regeneration step being higher than the temperature of the bed during the adsorption step).

The regeneration gas passed through the bed (40B) undergoing the regeneration step may, for example, comprise a portion (120) of the natural gas lean in heavy hydrocarbons (106) obtained from the outlet of the bed (40A) undergoing the adsorption step. Alternatively or additionally, the regeneration gas may, for example, comprise a stream (111) of flash or boil-off gas, obtained from processing or storage of the LNG stream (110) in, for example, and LNG storage facility (91), and which has first been compressed in a compressor (92). It should be noted that, as illustrated in FIG. 1(*d*), said compressed flash or boil-off gas may additionally or alternatively be used as all or part of the stripping gas (112) for the stripping column (30), which compressed flash or boil-off gas may be used in addition to or as an alternative to any and all of the sources of stripping gas discussed above.

The stream of desorbed gas (121) exiting the bed (40B) or beds of the adsorption system during regeneration thereof, which will typically be at a lower pressure than the pressure of the natural gas feed stream (102) to the striping column (30), can then be cooled down and partially condensed in a cooler (60), and phase separated in a phase separator (70) into a liquid condensate stream (124) containing the majority of the heavy hydrocarbons and a natural gas vapour stream (125).

As shown in FIG. 1(*d*), this recovered natural gas vapour stream (125) can be recompressed in a compressor (50) and cooled in a further cooler (80), and can then be recycled by being reintroduced into the stripping column (30) at a location below the natural gas feed stream (102), thereby providing yet another additional or alternative source of stripping gas. The cooler (80) after the compressor (50) is optional, and can be used to control the temperature of the recovered natural gas stream (125) entering the stripping column. Alternatively, as shown in FIG. 1(*e*), the recovered natural gas vapour stream (125) can be recovered by being recycled into the natural gas feed stream (100), for example upstream of a feed gas boost compressor (51). In-between the feed gas boost compressor (51) and the economizer heat exchanger (10) there may be various equipment (generically indicated as unit 55), such as for example a dryer, cooler, etc.

Although FIGS. 1(*d*) and 1(*e*) depict only two parallel adsorption beds (40A and 40B), this is merely for the sake of brevity, and in practice the methods depicted in these Figures can be carried out using single or multiple adsorption beds, in parallel or in series.

It should also be noted that the method and apparatus described above, in which the bed or beds of the TSA system are regenerated using a gas comprising a flash gas or boil-off gas obtained from the LNG stream, can equally be applied to other forms of regenerative adsorption system (such as PSA systems), and indeed to methods and apparatus for removing heavy hydrocarbons from a natural gas stream where an adsorption system is used on its own (i.e. not in combination with a gas-liquid separation system) or in conjunction with any other system.

Finally, with reference to FIG. 1(*f*), another embodiment is shown that varies from that depicted in FIG. 1(*d*) in that the stripping column (30) comprises at least two separations stages such that there are separation stages both above and below the point of entry of the recovered natural gas stream (125) into the stripping column (both stages therefore being below the point of entry of the natural gas feed stream (101)).

As also illustrated in this Figure, a yet further source of stripping gas to the stripping column (30) may be provided by using a reboiler (90) at the bottom of the column to reboil a portion of the heavy hydrocarbon enriched liquid stream (103) obtained from the bottom of the stripping column, this reboiled portion then being reintroduced into the bottom as stripping gas. The heat source for the reboiler can be steam, hot oil, electric power, or any stream that is hotter than the desired vapor temperature returning to the column. This use of such a reboiler may equally be applied to any of the preceding embodiments in which a stripping column is used.

FIGS. 2(*a*)-(*d*)

In the second group of embodiments, depicted in FIGS. 2(*a*)-(*d*), the gas-liquid separation system is again upstream of the adsorption system, such that the gas-liquid separation system processes the natural gas feed stream (from which heavy hydrocarbons are to be removed) to produce a heavy hydrocarbon depleted natural gas stream, and the adsorption system processes at least a portion of the heavy hydrocarbon depleted natural gas stream from the gas-liquid separation system to produce the desired natural gas stream lean in heavy hydrocarbons. However, as compared to the first group of embodiments (depicted in FIGS. 1(*a*)-(*f*)) the second group of embodiments (depicted in FIGS. 2(*a*)-(*d*)) differs in the manner in which the natural gas feed stream to the gas-liquid separation system is cooled and the heavy hydrocarbon depleted natural gas vapor stream from the gas-liquid separation system is warmed.

More specifically, in the second group of embodiments the natural gas feed stream is again introduced into the gas-liquid separation system and separated into a heavy hydrocarbon depleted natural gas vapor stream and a heavy hydrocarbon enriched liquid stream, and the heavy hydrocarbon depleted natural gas vapor stream or a portion thereof is passed through the one or more beds of the adsorption system to adsorb heavy hydrocarbons therefrom and thereby further reduce the concentration of heavy hydrocarbons in said stream (thereby providing the desired natural gas stream lean in heavy hydrocarbons). However, in the second group of embodiments the heavy hydrocarbon depleted natural gas vapor stream is warmed in an economizer heat exchanger, prior said stream or portion thereof to being passed through the one or more beds of the adsorption system, via indirect heat exchange with at least a portion of the natural gas stream lean in heavy hydrocarbons obtained from the adsorption system (at least a portion of the natural gas stream lean in heavy hydrocarbons therefore being also cooled in said economizer heat exchanger to provide a cooled natural gas stream lean in heavy hydrocarbons).

Due to the fact that, in the second group of embodiments, the refrigeration recovered from the heavy hydrocarbon depleted natural gas vapor stream is transferred in the economizer heat exchanger to at least a portion of the natural gas stream lean in heavy hydrocarbons rather than (as in the first group of embodiments) to the natural gas feed stream, in the second group of embodiments a colder temperature natural gas stream lean in heavy hydrocarbons is obtained (as compared to the natural gas stream lean in heavy hydrocarbons that is obtained in the first group of embodiments) but an additional source of refrigeration for the natural gas feed stream is required (to "replace" the refrigeration that, in the first group of embodiments, was being supplied to the natural gas feed stream by the economizer heat exchanger).

Thus, in contrast to the first group of embodiments (where it is preferably the case that the natural gas stream lean in heavy hydrocarbons is liquefied by being introduced into the warm end of and withdrawn from the cold end of a natural gas liquefier), in the second group of embodiments it is preferably the case that the natural gas feed stream is cooled prior to being introduced into the gas-liquid separation system by being introduced into the warm end of and withdrawn from an intermediate location of a natural gas liquefier, and that the cooled natural gas stream lean in heavy hydrocarbons obtained from the economizer heat exchanger is liquefied by being introduced into an intermediate location of and withdrawn from the cold end of the liquefier.

Referring now to FIG. 2(*a*), an embodiment is shown in which a methane rich natural gas feed stream (100, 201) is introduced into the warm end of a natural gas liquefier (90), is cooled in the warm stage of the liquefier, and withdrawn from an intermediate location (i.e. a location between two cooling stages of the liquefier, and thus neither at the warm end nor at the cold end of the liquefier) as a cooled natural gas stream (202). This cooled natural gas stream (202) exiting the intermediate location of the liquefier (90) may be a partially condensed stream (i.e. it may have been cooled and partially condensed in the warm stage of the liquefier). Alternatively, the natural gas stream (202) exiting the intermediate location of the liquefier (90) may also be reduced in pressure (for example using a J-T valve, not shown) in order to further cool and partially condense the natural gas stream (202).

In FIGS. 2(*a*)-(*d*) the liquefier is depicted as a single unit having two cooling stages. For example, where the liquefier is a wound-coil heat exchanger, it may comprise two bundles, each bundle representing a cooling stage. However, it is equally the case that liquefier may comprise more cooling stages, and instead of the stages all being contained in a single unit the liquefier may comprise more than one unit, arranged in series, with the cooling stages being distributed amongst the units.

The cooled and partially condensed natural gas stream (202) is then introduced into the top of a stripping column (30) where, as in the embodiment described above with reference to FIG. 1(*a*), it is separated into a heavy hydrocarbon depleted natural gas vapor (204) that is withdrawn from the top of the stripping column and a heavy hydrocarbon enriched liquid (203) that is removed from the bottom of the stripping column. A stripping gas (209) is again also introduced into the stripping column, at the bottom thereof, and the stripping column may again comprise one or more separation stages separating the feed locations of the natural gas feed stream and stripping gas.

The heavy hydrocarbon depleted natural gas vapor stream (204) withdrawn from the top of the stripping column (30) is then passed through an economizer heat exchanger (10) to recover refrigeration therefrom. Typically, the economizer heat exchanger (10) warms the heavy hydrocarbon depleted natural gas vapor stream (204) up to a temperature of (0-40° C.).

The warmed heavy hydrocarbon depleted natural gas vapor stream (205) from the economizer heat exchanger (20) is then sent to temperature swing adsorption system (40), which again comprising one or more beds of adsorbent selective for the heavy hydrocarbon components of the natural gas stream, the heavy hydrocarbon depleted natural gas vapor stream (205) being passed through one or more of said beds to further reduce (down to acceptable levels) the concentration of heavy hydrocarbons in said stream and provide the desired natural gas stream lean in heavy hydrocarbons (206). Again, where the absorber system (40) comprises a plurality of beds these can arranged in series and/or in parallel, and again the heavy hydrocarbons adsorbed by the adsorbent(s) can subsequently be removed in an adsorbent regeneration step (not shown in the figure).

The natural gas stream lean in heavy hydrocarbons (206) obtained from the outlet of the adsorption system (40) is then passed through economizer heat exchanger (10) where it is cooled down via indirect heat exchange with heavy hydrocarbon depleted natural gas vapor stream (204), thereby recovering refrigeration therefrom as previously described. The cooled natural gas stream (208) lean in heavy hydrocarbons exiting in the economizer heat exchanger (30) is then returned to an intermediate location of the natural gas liquefier (90), preferably the same intermediate location as the intermediate location from which the cooled and partially condensed natural gas stream (202) is withdrawn, and cooled and liquefied in the cold stage (or colder stages) of the liquefier to provide a LNG stream (110) withdrawn from the cold end of the liquefier.

Referring now to FIG. 2(*b*), in an alternative embodiment a phase separator (31) can be used (in place of the stripping column used in the embodiment depicted in FIG. 2(*a*)) to separate the partially condensed natural gas feed stream (202) into the heavy hydrocarbon depleted natural gas vapor (204), withdrawn from the top of the phase separation vessel, and the heavy hydrocarbon enriched liquid (203), withdrawn from the bottom of the vessel. As described above in relation to the operation of the phase separator depicted in FIG. 1(*b*), the phase separator (31) does not contain any separation stages or make use of a stripping gas, and thus in this embodiment no stripping gas is generated or used. As compared to the embodiment depicted in FIG. 2(*a*), the embodiment in FIG. 2(*b*) has the advantage of lower capital costs but the disadvantage that it loses more methane in the heavy hydrocarbon enriched liquid stream (203).

Similar to the various embodiments of the first group of embodiments depicted in FIGS. 1(*d*)-(*f*), in those embodiments of the second group of embodiments where a stripping column (30) is used it is possible to obtain the stripping gas for the stripping column from a variety of sources, and it is again possible to recover through the stripping column a some of the gas generated during regeneration of the bed or beds of the adsorption system (40). These variations are further illustrated in FIGS. 2(*c*) and (*d*).

Thus, referring to FIG. 2(*c*), although it is preferred that the stripping gas (or at least a portion thereof) supplied to the stripping column (30) is a stream of natural gas (209) taken from the natural gas feed stream (100) upstream of the liquefier (90) (as also depicted in FIG. 2(*a*), various additional and/or alternative sources are available. For example, the stripping gas may additionally or alternatively comprise one or more of: a portion (219) of the warmed natural gas stream depleted in heavy hydrocarbons (205) from the economiser heat exchanger (10); a portion (208) of the natural gas stream lean in heavy hydrocarbons (206) from the temperature swing adsorption system (40) (in which case only a portion (107) of said natural gas stream lean in heavy hydrocarbons (106) is then cooled in economizer heat exchanger (10) and sent to the liquefier (90) for liquefaction); or a flash or boil-off gas (111, 112) obtained from processing or storage of the LNG stream (110) in, for example, and LNG storage facility (91). Such additional/alternative sources of stripping gas will typically require compression prior to being used as the stripping gas (in for example compressors 75 or 92 as depicted in FIG. 2(*c*)).

With reference to FIGS. 2(*c*) and (*d*), the adsorption system may for example comprise one, two, or more, beds (40A and 40B), arranged and operated in any of the manners as described above with reference to FIGS. 1(*d*)-(*f*), with a regeneration gas being passed through said beds during the regeneration thereof and some of the gas generated during regeneration of the bed or beds being recovered through the stripping column. In particular, the regeneration gas may comprise a portion (120) of the natural gas lean in heavy hydrocarbons (106), obtained from the outlet of the bed (40A) undergoing the adsorption step, or a stream (111) of flash or boil-off gas. The stream of desorbed gas (121)

exiting the bed or beds being regenerated (40B) can then be cooled down and partially condensed in a cooler (60), and phase separated in an phase separator (70) into a liquid condensate stream (124), containing the majority of the heavy hydrocarbons, and a natural gas vapour stream (125).

As shown in FIG. 2(*c*), the recovered natural gas vapour stream (125) can then be recompressed in a compressor (50) and cooled in a further cooler (80), and then recycled by being reintroduced into the stripping column (30) at a location below the natural gas feed stream (102), thereby providing yet another additional or alternative source of stripping gas. The cooler after the compressor (50) is optional and can be used to control the temperature of the recovered natural gas stream (125) entering the stripping column. Alternatively, as shown in FIG. 2(*d*), the recovered natural gas vapour stream (125) can be recovered by being recycled into the natural gas feed stream (100), for example upstream of a feed gas boost compressor (51). In-between the feed gas boost compressor (51) and the economizer heat exchanger (10) there may be various equipment (generically indicated as unit 55), such as for example a dryer, cooler, etc.

FIGS. 3(*a*)-(*d*)

In the third group of embodiments, depicted in FIGS. 3(*a*)-(*d*), the adsorption system is upstream of the gas-liquid separation system, such that such that the adsorption system processes the natural gas feed stream (from which heavy hydrocarbons are to be removed) to produce a heavy hydrocarbon depleted natural gas stream, and the gas-liquid separation system processes at least a portion of a heavy hydrocarbon depleted natural gas stream from the adsorption system to produce the desired natural gas stream lean in heavy hydrocarbons.

More specifically, in the third group of embodiments the natural gas feed stream is passed through the one or more beds of the adsorption system to adsorb heavy hydrocarbons therefrom, thereby producing a heavy hydrocarbon depleted natural gas stream. At least a portion of the heavy hydrocarbon depleted natural gas stream is cooled and then introduced into the gas-liquid separation system and separated into a natural gas vapor stream that is further depleted in heavy hydrocarbons (thereby providing the desired natural gas stream lean in heavy hydrocarbons), and a heavy hydrocarbon enriched liquid stream. Preferably, the heavy hydrocarbon depleted natural gas stream or portion thereof is cooled and the natural gas stream lean in heavy hydrocarbons is liquefied in a natural gas liquefier, the heavy hydrocarbon depleted natural gas stream or portion thereof being introduced into a warm end of the liquefier and withdrawn from an intermediate location of the liquefier, and the natural gas stream lean in heavy hydrocarbons being introduced into an intermediate location of the liquefier and withdrawn from a cold end of the liquefier.

The beds of the adsorption system in the third group of embodiments have to be larger than the beds of the adsorption system in the first and second groups of embodiments (depicted in FIGS. 1(*a*)-(*f*) and FIGS. 2(*a*)-(*d*)), because in the first and second groups of embodiments the gas-liquid separation system column removes the bulk of the heavy hydrocarbons in the natural gas feed stream. Put another way, for the same size of adsorber bed, the methods and apparatus according to the first and second groups of embodiments (depicted in FIGS. 1(*a*)-(*f*) and FIGS. 2(*a*)-(*d*)) can tolerate higher concentrations of heavy hydrocarbon in the natural gas feed, and offers better operational flexibility if the natural gas source changes or the concentrations of the heavy hydrocarbons fluctuate over a wide range. The smaller adsorption beds used in the first and second groups of embodiments also mean that these embodiments have lower requirements as regards regeneration gas usage and lower power costs in relation to feed gas compression. However, the embodiments in the third group of embodiments (as depicted in FIGS. 3(*a*)-(*d*)) do not need an economizer heat exchanger for recovery of refrigeration from the vapour stream obtained from the gas-liquid separation column, thereby providing savings in terms of capitals costs.

With reference to FIG. 3(*a*), in one embodiment a methane rich natural gas feed stream (100) is introduced into an adsorption system (40), which again comprising one or more beds of adsorbent selective for the heavy hydrocarbon components of the natural gas stream, the natural gas feed stream (100) being passed through one or more of said beds to adsorb heavy hydrocarbons therefrom, thereby producing a heavy hydrocarbon depleted natural gas stream (301). As described above in connection with the embodiments depicted in FIGS. 1 and 2, where the absorption system (40) comprises a plurality of beds these can arranged in series and/or in parallel, and again the heavy hydrocarbons adsorbed by the adsorbent(s) can subsequently be removed in an adsorbent regeneration step (not shown in FIG. 3(*a*)).

At least a portion (302) of the heavy hydrocarbon depleted natural gas stream (301) is then is introduced into the warm end of a natural gas liquefier (90), is cooled in the warm stage of the liquefier, and is withdrawn from an intermediate location of the liquefier as a cooled heavy hydrocarbon depleted natural gas stream (303). This cooled stream (303) exiting the intermediate location of the liquefier (90) may be a partially condensed stream (i.e. it may have been cooled and partially condensed in the warm stage of the liquefier). Alternatively, the cooled stream (303) exiting the intermediate location of the liquefier (90) may also be reduced in pressure (for example using a J-T valve, not shown) in order to further cool and partially condense stream. Again, although the liquefier is depicted in FIGS. 3(*a*)-(*d*) as a single unit having two cooling stages, it is equally the case that liquefier may comprise more cooling stages, and that the liquefier may comprise more than one unit, arranged in series, with the cooling stages being distributed amongst the units.

The cooled and partially condensed heavy hydrocarbon depleted natural gas stream (303) is introduced into the top of the stripping column (30) where it is separated into a natural gas vapor stream (305) withdrawn from the top of the column that is further depleted in heavy hydrocarbons (this stream being the desired natural gas stream lean in heavy hydrocarbons), and a heavy hydrocarbon enriched liquid (304) removed from the bottom of the column. A stripping gas is again introduced into the stripping column, at the bottom thereof, the stripping column comprising one or more separation stages separating the feed locations of the natural gas feed stream and stripping gas. The stripping gas can any come from a variety of different sources but, in the embodiment depicted in FIG. 3(*a*), comprises: a portion (306) of the heavy hydrocarbon depleted natural gas taken from the heavy hydrocarbon depleted natural gas stream (301) prior to the remainder (302) of said stream being cooled and partially condensed in the natural gas liquefier (90); and/or a stream of natural gas (307) taken from the natural gas feed stream (100) prior to the processing of the latter in the adsorption system (40).

The natural gas stream lean in heavy hydrocarbons (305) obtained from the top of the stripping column is then returned to an intermediate location of the natural gas liquefier (preferably the same intermediate location as the intermediate location from which the cooled and partially condensed heavy hydrocarbon depleted natural gas stream (303) is withdrawn) and cooled and liquefied in a cold stage (or colder stages) of the liquefier to provide a LNG stream (110) withdrawn from the cold end of the liquefier.

As with the first and second groups of embodiments, in the third group of embodiments a phase separator can be used instead of stripping column, which will save capital costs but increase the loss of methane in the heavy hydrocarbon enriched liquid stream (304).

Thus, referring now to FIG. 3(*b*), in an alternative embodiment a phase separator (31) is used (in place of the stripping column used in the embodiment depicted in FIG. 3(*a*)) to separate the partially condensed heavy hydrocarbon depleted natural gas stream (303) into the natural gas vapor stream (305) further depleted in heavy hydrocarbons depleted (the desired natural gas stream lean in heavy hydrocarbons), withdrawn from the top of the phase separation vessel, and a heavy hydrocarbon enriched liquid (304), withdrawn from the bottom of the vessel. As described above in relation to the operation of the phase separator depicted in FIG. 1(*b*), the phase separator (31) does not contain any separation stages or make use of a stripping gas, and thus in this embodiment no stripping gas is generated or used.

Similar to the various embodiments of the first group of embodiments depicted in FIGS. 1(*d*)-(*f*), in those embodiments of the third group of embodiments where a stripping column (30) is used it is again also possible to recover through the stripping column some of the gas generated during regeneration of the bed or beds of the adsorption system (40).

The stream of desorbed gas (121) exiting the bed or beds being regenerated (40B) can then be cooled down and partially condensed in a cooler (60), and phase separated in an phase separator (70) into a liquid condensate stream (124), containing the majority of the heavy hydrocarbons, and a natural gas vapour stream (125).

Thus, with reference to FIGS. 3(*c*) and (*d*), the adsorption system may for example comprise one, two, or more, beds (40A and 40B), arranged and operated in any of the manners as described above with reference to FIGS. 1(*d*)-(*f*), with a regeneration gas being passed through said beds during the regeneration thereof and some of the gas generated during regeneration of the bed or beds being recovered through the stripping column. In particular, the regeneration gas may comprise a portion (320) of the heavy hydrocarbon depleted natural gas stream (301), obtained from the outlet of the bed (40A) undergoing the adsorption step, or a stream (111) of flash or boil-off gas. The stream of desorbed gas (321) exiting the bed or beds being regenerated (40B) can then be cooled down and partially condensed in a cooler (60), and phase separated in a phase separator (70) into a liquid condensate stream (323), containing the majority of the heavy hydrocarbons, and a natural gas vapour stream (324).

As shown in FIG. 3(*c*), the recovered natural gas vapour stream (324) can then be recompressed in a compressor (50) and cooled in a further cooler (80), and then recycled by being reintroduced into the stripping column (30) at a location below the heavy hydrocarbon depleted natural gas stream (303), thereby providing yet another additional or alternative source of stripping gas (326). The cooler after the compressor (50) is optional and can be used to control the temperature of the recovered natural gas stream (324) entering the stripping column. The compressor (50) is also optional, and may not be needed if the adsorption system is regenerated at a pressure that is higher than the pressure at the bottom of the column. In a further variation, the phase separator (70) can also be omitted, such that all of the cooled stream of desorbed gas (321) exiting the cooler (60) is sent to the stripping column. As also illustrated in FIG. 3(*c*), the stripping column (30) may comprise at least two separations stages such that there are separation stages both above and below the point of entry of the recovered natural gas stream (324) into the stripping column, and stripping gas to the stripping column (30) may also be provided by using a reboiler (95) at the bottom of the column to reboil a portion of the heavy hydrocarbon enriched liquid stream (304) obtained from the bottom of the stripping column.

Alternatively, as shown in FIG. 3(*d*), the recovered natural gas vapour stream (324) can be recycled into the natural gas feed stream (100), for example upstream of a feed gas boost compressor (51). In-between the feed gas boost compressor (51) and the economizer heat exchanger (10) there may be various equipment (generically indicated as unit 55), such as for example a dryer, cooler, etc. As also illustrated in FIG. 3(*d*), flash or boil-off gas may again, additionally or alternatively, also be used as stripping gas (112) for the stripping column (30).

EXAMPLES

In order to demonstrate the effects of using, in accordance with the present invention, a TSA system and gas-liquid separation system in combination to remove heavy hydrocarbons from a natural gas stream, the performance of the embodiments depicted in FIGS. 1(*a*), 1(*e*), 2(*a*), 2(*b*), 2(*c*), 3(*a*), 3(*b*) and 3(*c*) in removing heavy hydrocarbons from a natural gas stream was compared to the performance of a prior art process (not in accordance with the present invention) that uses a scrub column, only, to remove heavy hydrocarbons from the natural gas stream. In the first run using the traditional (scrub column only) process, the operating conditions used for the scrub column would lead to a risk of scrub column dry-out (and resulting failure of the heavy hydrocarbon removal process). Therefore, a second run using the traditional (scrub column only) process was also conducted, using different operating conditions (namely a colder column temperature) that prevented any risk of column dry-out. The data for all runs, i.e. both those employing the aforementioned embodiments of the present invention and those employing the prior art (scrub column only) process, was generated using ASPEN™ Plus software (© Aspen Technology, Inc.) and an internal adsorption simulation tool, SIMPAC (a detailed adsorption process simulator, which considers multicomponent adsorption isotherms, various mass transfer modes, numerous adsorbent layers, and general process flowsheeting—more details of this simulator being provided in Kumar et al., Chemical Engineering Science, Volume 49, Number 18, pages 3115-3125).

The starting composition of the natural gas feed stream that was used (which was the same for all cases) is given below, in Table 1, and the composition of the product stream (i.e. the natural gas stream desired to be lean in heavy hydrocarbons, labelled in Table 2 as "Heavy Hydrocarbon Lean Stream") that was obtained from each embodiment (i.e. from each of the embodiments depicted in FIGS. 1(*a*), 1(*e*), 2(*a*), 2(*b*), 2(*c*), 3(*a*), 3(*b*) and 3(*c*)) and from the traditional (scrub column only) process (both runs) is given below, in Table 2. In Table 2, the first run employing the prior art (scrub column only) process where there was a risk of scrub column dry-out is indicated by the note "Tray may dry out", and the second run employing the prior art (scrub column only) process, where this risk was removed, is indicated by the note "NO Tray dry-out".

Table 2 also lists: the gas-liquid separation system operating conditions (i.e. the scrub column/stripping column/phase separator vessel temperature and pressure); the flow rate of heavy hydrocarbon enriched liquid obtained from the gas-liquid separation system as a percentage of the flow rate of the natural gas stream fed to said system (designated in the table as "LPG as % of Feed"); and the total LNG flow rate produced by each run, expressed as a percentage of the total LNG production flow rate obtained in the first run using the prior art process (designated in the table as "Relative LPG Production"). With reference to the data provided in Table 2, as is well known in the art the letter E when used as part of a number stands for exponent—thus, for example, in Table 2 the number 9.9E-01 refers to $9.9\times10^{-1}$, or 0.99.

As can be seen from the data in Table 2, the embodiments according to the present invention were able to effectively remove the heavy hydrocarbons from the NG gas stream and provide increased LNG production compared to that provided by the prior art (scrub column only) process, despite the gas-liquid separation system in the embodiments according to the present invention being operated at higher temperatures or higher pressures (thereby consuming less energy) than the temperature and pressure of the scrubbing column in the prior art process (even in the prior art process run where the scrubbing column was operated at a temperature risking column dry-out).

Figure 4:
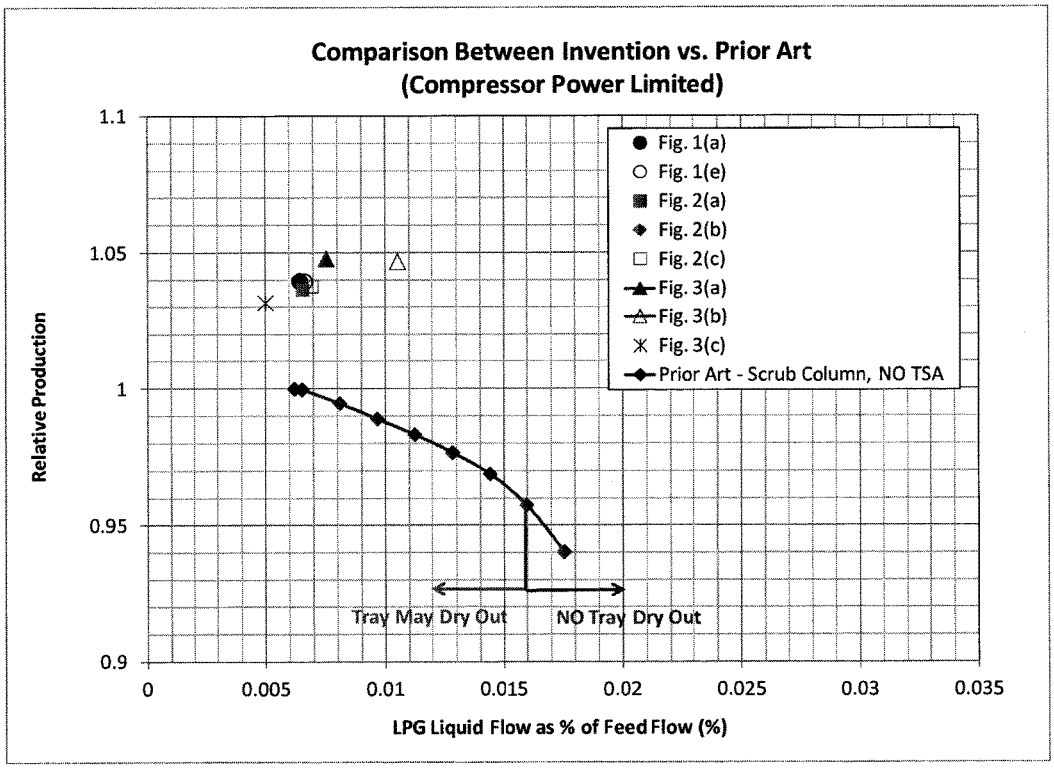
FIG. 4 is a graph plotting the results of using in series an adsorption system and a gas-liquid separation system to remove heavy hydrocarbons from a natural gas feed stream, as compared to using a scrubbing column on its own to remove heavy hydrocarbons from a natural gas feed stream.

These results are also shown in FIG. 4, in which relative LNG production (i.e. the total LNG flow rate produced by each run, expressed as a fraction of the best total LNG production flow rate obtained using the prior art process) is plotted against LPG Flow as a % of Feed Flow (i.e. the flow rate of heavy hydrocarbon enriched liquid obtained from the gas-liquid separation system as a percentage of the flow rate of the natural gas stream fed to said system). As is again shown, the embodiments according to the present invention provide improved LNG production rates as compared to the prior art process, even where the prior art process is run under conditions risking column dry out, and these benefits are even more marked in comparison to those runs of the prior art process which were run under operating conditions that prevent any risk of column dry out (i.e. sufficiently high LPG Flow as a % of Feed Flow, as provided by operating the scrub column at lower temperatures to increase the amount of heavy hydrocarbon enriched liquid produced).

TABLE 1

Feed Composition

| Component | mol % |
|---|---|
| Nitrogen | 7.0E−01 |
| Methane | 9.6E+01 |
| Ethane | 2.8E+00 |
| Propane | 4.8E−01 |
| i-Butane | 5.0E−02 |
| n-Butane | 8.5E−02 |
| i-Pentane | 2.0E−02 |
| n-Pentane | 2.2E−02 |
| Cyclo-Pentane | 3.0E−05 |
| n-Hexane | 3.2E−02 |
| Cyclo-Hexane | 5.0E−05 |
| Methyl-Cyclohexane | 4.0E−05 |
| Heptane | 2.9E−02 |
| Octane | 3.3E−03 |
| Nonane | 1.1E−03 |
| Benzene | 1.9E−02 |
| Toluene | 3.4E−03 |

TABLE 2

Stream Compositions and Column/Separator Operating Conditions

| Configuration | | Prior Art-Scrub Column | Prior Art-Scrub Column | 1(a) | 1(e) | 2(a) | 2(b) | 2(c) | 3(a) | 3(b) | 3(c) |
|---|---|---|---|---|---|---|---|---|---|---|---|
| NOTE | | Tray may dry out | NO Tray Dry-out | | | | | | | | |
| LPG as % of Feed | % | 0.63% | 1.67% | 0.64% | 0.66% | 0.65% | 0.70% | 0.69% | 0.75% | 1.05% | 0.50% |
| Relative LNG Production | % | 100.0% | 95.7% | 104.0% | 104.0% | 103.7% | 104.7% | 103.8% | 104.8% | 104.7% | 103.2% |
| Heavy Hydrocarbon Lean Stream | | | | | | | | | | | |
| Nitrogen | mol % | 9.9E−01 | 1.0E+00 | 9.8E−01 | 1.1E+00 | 9.8E−01 | 9.8E−01 | 1.0E+00 | 9.8E−01 | 9.8E−01 | 1.0E+00 |
| Methane | mol % | 9.6E+01 | 9.6E+01 | 9.6E+01 | 9.6E+01 | 9.6E+01 | 9.6E+01 | 9.6E+01 | 9.6E+01 | 9.6E+01 | 9.6E+01 |
| Ethane | mol % | 2.7E+00 | 2.6E+00 | 2.7E+00 | 2.7E+00 | 2.7E+00 | 2.7E+00 | 2.7E+00 | 2.7E+00 | 2.7E+00 | 2.7E+00 |
| Propane | mol % | 4.6E−01 | 2.8E−01 | 4.5E−01 | 4.5E−01 | 4.5E−01 | 4.5E−01 | 4.5E−01 | 4.4E−01 | 4.3E−01 | 4.7E−01 |
| i-Butane | mol % | 4.4E−02 | 1.2E−02 | 4.3E−02 | 4.3E−02 | 4.3E−02 | 4.3E−02 | 4.3E−02 | 3.7E−02 | 3.7E−02 | 4.9E−02 |
| n-Butane | mol % | 7.1E−02 | 1.9E−02 | 6.9E−02 | 6.9E−02 | 6.9E−02 | 6.9E−02 | 6.9E−02 | 5.6E−02 | 5.6E−02 | 8.2E−02 |
| i-Pentane | mol % | 1.2E−02 | 8.9E−04 | 1.2E−02 | 1.2E−02 | 1.2E−02 | 1.2E−02 | 1.2E−02 | 8.0E−03 | 8.0E−03 | 1.9E−02 |
| n-Pentane | mol % | 1.0E−02 | 5.3E−04 | 1.2E−02 | 1.2E−02 | 1.2E−02 | 1.2E−02 | 1.2E−02 | 7.3E−03 | 7.3E−03 | 2.0E−02 |
| Cyclo-Pentane | mol % | 3.3E−06 | 7.9E−07 | 1.2E−05 | 1.1E−05 | 1.2E−05 | 1.2E−05 | 1.2E−05 | 6.6E−06 | 6.6E−06 | 1.5E−05 |
| n-Hexane | mol % | 1.0E−04 | 9.7E−06 | 8.3E−03 | 8.3E−03 | 8.8E−03 | 8.8E−03 | 8.8E−03 | 3.8E−03 | 3.9E−03 | 3.1E−03 |
| Cyclo-Hexane | mol % | 9.5E−09 | 5.0E−08 | 7.5E−06 | 7.3E−06 | 8.1E−06 | 8.0E−06 | 7.9E−06 | 3.6E−06 | 3.6E−06 | 2.7E−06 |
| Methyl-Cyclohexane | mol % | 2.0E−10 | 2.7E−09 | 3.5E−06 | 3.4E−06 | 4.0E−06 | 4.0E−06 | 3.9E−06 | 1.1E−03 | 1.1E−03 | 5.0E−04 |
| Heptane | mol % | 2.1E−08 | 1.0E−07 | 2.2E−03 | 2.1E−03 | 0.0E+00 | 0.0E+00 | 0.0E+00 | 1.2E−04 | 1.3E−04 | 7.9E−05 |
| Octane | mol % | 1.3E−13 | 4.2E−11 | 0.0E+00 | 0.0E+00 | 0.0E+00 | 0.0E+00 | 0.0E+00 | 6.6E−06 | 6.6E−06 | 3.6E−06 |
| Nonane | mol % | 2.0E−17 | 1.1E−13 | 0.0E+00 | 0.0E+00 | 0.0E+00 | 0.0E+00 | 0.0E+00 | 1.6E−07 | 1.7E−07 | 8.4E−08 |
| Benzene | mol % | 6.0E−05 | 4.8E−05 | 0.0E+00 | 0.0E+00 | 0.0E+00 | 0.0E+00 | 0.0E+00 | 6.0E−05 | 6.0E−05 | 6.0E−05 |
| Toluene | mol % | 8.5E−09 | 6.0E−08 | 2.8E−04 | 2.7E−04 | 3.2E−04 | 3.2E−04 | 3.1E−04 | 1.2E−04 | 1.3E−04 | 7.9E−05 |

TABLE 2-continued

| Stream Compositions and Column/Separator Operating Conditions | | | | | | | | | | | |
|---|---|---|---|---|---|---|---|---|---|---|---|
| Configuration | | Prior Art-Scrub Column | Prior Art-Scrub Column | 1(a) | 1(e) | 2(a) | 2(b) | 2(c) | 3(a) | 3(b) | 3(c) |
| Column/Phase Separator Operating Conditions | | | | | | | | | | | |
| Temperature | C. | −65.0 | −73.8 | −51.2 | −51.2 | −54.5 | −53.4 | −53.8 | −60.1 | −60.3 | −55.7 |
| Pressure | bara | 48.5 | 48.3 | 53.5 | 54.0 | 56.9 | 56.3 | 57.3 | 48.7 | 48.7 | 47.2 |

It will be appreciated that the invention is not restricted to the details described above with reference to the preferred embodiments but that numerous modifications and variations can be made without departing form the spirit or scope of the invention as defined in the following claims.

The invention claimed is:

1. A method of removing heavy hydrocarbons from a natural gas feed stream, wherein the heavy hydrocarbons are aliphatic hydrocarbons having six or more carbon atoms in total and/or aromatic hydrocarbons, the method comprising the steps of:

cooling the natural gas feed stream;

introducing the cooled natural gas feed stream into a gas-liquid separation system, comprising a stripping column or a phase separator, and separating the cooled natural gas feed stream into a heavy hydrocarbon depleted natural gas vapor stream and a heavy hydrocarbon enriched liquid stream;

warming the heavy hydrocarbon depleted natural gas vapor stream;

passing at least a portion of the warmed heavy hydrocarbon depleted natural gas vapor stream through one or more beds of adsorbent of an adsorption system to adsorb heavy hydrocarbons therefrom, whereby the adsorbent is selective for the heavy hydrocarbons, thereby producing a natural gas stream lean in heavy hydrocarbons; and cooling at least a portion of the natural gas stream lean in heavy hydrocarbons to produce a cooled natural gas stream lean in heavy hydrocarbons;

wherein the heavy hydrocarbon depleted natural gas vapor stream is warmed and the at least a portion of the natural gas stream lean in heavy hydrocarbons is cooled in an economizer heat exchanger via indirect heat exchange between the heavy hydrocarbon depleted natural gas vapor stream and the at least a portion of the natural gas stream lean in heavy hydrocarbons.

2. The method of claim 1, wherein the method is further a method of producing a liquefied natural gas stream, and further comprises liquefying at least a portion of the cooled natural gas stream lean in heavy hydrocarbons.

3. The method of claim 2, wherein the natural gas feed stream is cooled and the at least a portion of the cooled natural gas stream lean in heavy hydrocarbons is liquefied in a liquefier, the natural gas feed stream being introduced into a warm end of the liquefier and withdrawn from an intermediate location of the liquefier, and the cooled natural gas stream lean in heavy hydrocarbons being introduced into an intermediate location of the liquefier and withdrawn from a cold end of the liquefier.

4. The method of claim 1, wherein the gas-liquid separation system is a stripping column, the method further comprising introducing a stripping gas into the stripping column at a location below the location at which the cooled natural gas feed stream is introduced into the stripping column.

5. The method of claim 1, wherein the gas liquid separation system is a stripping column, the method further comprising introducing a stripping gas into the stripping column at a location below the location at which the cooled natural gas feed stream is introduced into the stripping column, and wherein the stripping gas comprises one or more gases selected from the group consisting of: natural gas taken from the natural gas feed stream prior to said stream being cooled and introduced into the stripping column; a portion of the natural gas stream lean in heavy hydrocarbons that is not cooled in the economizer heat exchanger; a portion of the natural gas stream depleted in heavy hydrocarbons that has been warmed in the economiser heat exchanger; a gas obtained from re-boiling all or a portion of the heavy hydrocarbon enriched liquid stream; and a flash or boil-off gas obtained from a liquefied natural gas.

6. The method of claim 1, wherein the adsorption system is a temperature swing adsorption system, and the method further comprises regenerating the one or more beds of the temperature swing adsorption system by passing a gas, selected from a portion of the natural gas stream lean in heavy hydrocarbons or a flash or boil off gas obtained from a liquefied natural gas, through the one or more beds, the temperature of the one or more beds during regeneration being higher than the temperature of the one or more beds during adsorption of heavy hydrocarbons from the heavy hydrocarbon depleted natural gas vapor stream or portion thereof.

7. The method of claim 6, wherein the method further comprises cooling and separating into liquid and vapor phases the gas obtained from the one or more beds of the temperature swing adsorption system during regeneration of said one or more beds, and recycling the vapor phase into the natural gas feed stream prior to the introduction thereof into the gas-liquid separation system.

8. The method of claim 6, wherein the gas liquid separation system is a stripping column, and the method further comprises cooling and separating into liquid and vapor phases the gas obtained from the one or more beds of the temperature swing adsorption system during regeneration of said one or more beds, and introducing the vapor phase as a stripping gas into the stripping column at a location below the location at which the cooled natural gas feed stream is introduced into the stripping column.

9. The method of claim 1, wherein the natural gas feed stream is lean in aliphatic hydrocarbons having from 3 to 5 carbon atoms in total, and/or is lean in aliphatic hydrocarbons having from 2 to 5 carbon atoms in total.

10. An apparatus for removing heavy hydrocarbons from a natural gas feed stream and producing a liquefied natural gas stream, wherein the heavy hydrocarbons are aliphatic hydrocarbons having six or more carbon atoms in total and/or aromatic hydrocarbons, the apparatus comprising:

a gas-liquid separation system, comprising a stripping column or a phase separator, for receiving and separating the natural gas feed stream into a heavy hydrocarbon depleted natural gas vapor stream and a heavy hydrocarbon enriched liquid stream;

an adsorption system, in fluid flow communication with the gas-liquid separation system, for receiving at least a portion of the heavy hydrocarbon depleted natural gas vapor stream, and comprising one or more beds of adsorbent for adsorbing heavy hydrocarbons from said at least a portion of the heavy hydrocarbon depleted natural gas vapor stream, whereby the adsorbent is selective for the heavy hydrocarbons, to thereby produce a natural gas stream lean in heavy hydrocarbons;

an economizer heat exchanger for warming the heavy hydrocarbon depleted natural gas vapor stream, prior to said stream or portion thereof being passed through the one or more beds of the adsorption system, and cooling at least a portion of the natural gas stream lean in heavy hydrocarbons via indirect heat exchange between the heavy hydrocarbon depleted natural gas vapor stream and the at least a portion of the natural gas stream lean in heavy hydrocarbons; and a liquefier connected in fluid flow communication with the gas-liquid separation system and the second heavy hydrocarbon removal system, for receiving and cooling the natural gas feed stream prior to said stream being introduced into the gas-liquid separation system, and for receiving and liquefying at least a portion of the natural gas stream lean in heavy hydrocarbons to produce the liquefied natural gas stream, the natural gas feed stream being introduced into a warm end of the liquefier and withdrawn from an intermediate location of the liquefier, and the at least a portion of the natural gas stream lean in heavy hydrocarbons being introduced into an intermediate location of the liquefier and withdrawn from a cold end of the liquefier.

* * * * *